US011355080B2

(12) United States Patent
Li et al.

(10) Patent No.: US 11,355,080 B2
(45) Date of Patent: Jun. 7, 2022

(54) DISPLAY PANEL, DISPLAY DEVICE AND DISPLAY METHOD

(71) Applicant: Xiamen Tianma Micro-Electronics Co., Ltd., Xiamen (CN)

(72) Inventors: Yaying Li, Xiamen (CN); Hailiang Wang, Xiamen (CN); Yan Yang, Xiamen (CN); Ting Zhou, Xiamen (CN); Junyi Li, Xiamen (CN)

(73) Assignee: Xiamen Tianma Micro-Electronics Co., Ltd., Xiamen (CN)

( * ) Notice: Subject to any disclaimer, the term of this patent is extended or adjusted under 35 U.S.C. 154(b) by 0 days.

(21) Appl. No.: 17/215,257

(22) Filed: Mar. 29, 2021

(65) Prior Publication Data

US 2021/0217372 A1 Jul. 15, 2021

(30) Foreign Application Priority Data

Dec. 31, 2020 (CN) ..... 202011643652.9

(51) Int. Cl.
*G09G 3/36* (2006.01)

(52) U.S. Cl.
CPC ..... *G09G 3/3607* (2013.01); *G09G 3/3677* (2013.01); *G09G 3/3688* (2013.01); *G09G 2300/0452* (2013.01); *G09G 2300/0465* (2013.01)

(58) Field of Classification Search
CPC .. G09G 3/3607; G09G 3/3677; G09G 3/3688; G09G 2300/0452; G09G 2300/0465
See application file for complete search history.

(56) References Cited

U.S. PATENT DOCUMENTS

2021/0056913 A1* 2/2021 Ko ..... H01L 27/3218

FOREIGN PATENT DOCUMENTS

| | | | |
|---|---|---|---|
| CN | 108881530 | A | 11/2018 |
| CN | 109285860 | A | 1/2019 |
| CN | 208384467 | U | 1/2019 |
| CN | 110570774 | A | 12/2019 |
| CN | 110971805 | A | 4/2020 |

* cited by examiner

*Primary Examiner* — Kenneth B Lee, Jr.
(74) *Attorney, Agent, or Firm* — Tarolli, Sundheim, Covell & Tummino LLP

(57) ABSTRACT

Embodiments of the present disclosure provides a display panel, a display device, and a display method. A density of a first pixel unit in a first display area is smaller than a density of a second pixel unit in a second display area. In the first pixel unit, a first sub-pixel row includes sub-pixels of different colors arranged along a first direction, and a second sub-pixel row includes first high-transmittance sub-pixels. A plurality of first pixel units are arranged along a second direction to form a first pixel unit column. In one of first pixel unit columns, the first sub-pixel rows and the second sub-pixel rows are alternately arranged. Two closest first sub-pixel rows are located in two adjacent first pixel unit columns and staggered from each other in the first direction.

19 Claims, 18 Drawing Sheets

DISPLAY PANEL, DISPLAY DEVICE AND DISPLAY METHOD

CROSS-REFERENCE TO RELATED APPLICATIONS

The present disclosure claims priority to Chinese Patent Application No. 202011643652.9, filed on Dec. 31, 2020, the content of which is incorporated herein by reference in its entirety.

TECHNICAL FIELD

The present disclosure relates to the field of display technology and, in particular, to a display panel, a display device, and a display method.

BACKGROUND

With the increase of users' demand for diversified use of display devices and emergence of design requirements for high screen-to-body ratios of display devices, a light-collecting module is provided on a back side of a display area of the display panel. For example, an under-screen camera technology provides a camera on the back side of the display area in the display panel. The back side is a side facing away from a light emission side of the display panel. With such design, with increasing the screen-to-body ratio of the display device, higher requirements for light transmittance at the light-collecting module in the display panel are put forward. Moreover, on this basis, how to make a position where the light-collecting module is correspondingly provided in the display panel to have a better display effect has also become a research focus of relevant technicians.

SUMMARY

In one aspect, an embodiment of the present disclosure provides a display panel. The display panel has a first display area and a second display area, and the second display area at least partially surrounds the first display area. The display panel includes a plurality of first pixel units arranged in the first display area and a plurality of second pixel units arranged in the second display area. A density of the plurality of first pixel units is smaller than a density of the plurality of second pixel units. Each of the plurality of first pixel units includes a first sub-pixel row and a second sub-pixel row, the first sub-pixel row includes a plurality of sub-pixels of different colors arranged along a first direction, and the second sub-pixel row includes first high-transmittance sub-pixels. The first sub-pixel row and the second sub-pixel row are arranged along a second direction, and the first direction intersects the second direction. In the first display area, at least two of the plurality of first pixel units are arranged along the second direction to form one of first pixel unit columns, and the first pixel unit columns are arranged along the first direction. In one of the first pixel unit columns, the first sub-pixel rows and the second sub-pixel rows of at least two of the plurality of first pixel units are alternately arranged. Two closest first sub-pixel rows of the first sub-pixel rows of the plurality of first pixel units are respectively located in two adjacent ones of the first pixel unit columns and are staggered from each other in the first direction.

In another aspect, an embodiment of the present disclosure provides a display device. The display device includes a light-collecting module and a display panel, and an orthographic projection of the light-collecting module on a plane of the display panel is located in the first display area. The display panel has a first display area and a second display area, and the second display area at least partially surrounds the first display area. The display panel includes a plurality of first pixel units arranged in the first display area and a plurality of second pixel units arranged in the second display area. A density of the plurality of first pixel units is smaller than a density of the plurality of second pixel units. Each of the plurality of first pixel units includes a first sub-pixel row and a second sub-pixel row, the first sub-pixel row includes a plurality of sub-pixels of different colors arranged along a first direction, and the second sub-pixel row includes first high-transmittance sub-pixels. The first sub-pixel row and the second sub-pixel row are arranged along a second direction, and the first direction intersects the second direction. In the first display area, at least two of the plurality of first pixel units are arranged along the second direction to form one of first pixel unit columns, and the first pixel unit columns are arranged along the first direction. In one of the first pixel unit columns, the first sub-pixel rows and the second sub-pixel rows of at least two of the plurality of first pixel units are alternately arranged. Two closest first sub-pixel rows of the first sub-pixel rows of the plurality of first pixel units are respectively located in two adjacent ones of the first pixel unit columns and are staggered from each other in the first direction.

In still another aspect, an embodiment of the present disclosure provides a driving method applied to a display panel, and the display panel has a display mode and a light-collecting mode. The display panel has a first display area and a second display area, and the second display area at least partially surrounds the first display area. The display panel includes a plurality of first pixel units arranged in the first display area and a plurality of second pixel units arranged in the second display area. A density of the plurality of first pixel units is smaller than a density of the plurality of second pixel units. Each of the plurality of first pixel units includes a first sub-pixel row and a second sub-pixel row, the first sub-pixel row includes a plurality of sub-pixels of different colors arranged along a first direction, and the second sub-pixel row includes first high-transmittance sub-pixels. The first sub-pixel row and the second sub-pixel row are arranged along a second direction, and the first direction intersects the second direction. In the first display area, at least two of the plurality of first pixel units are arranged along the second direction to form one of first pixel unit columns, and the first pixel unit columns are arranged along the first direction. In one of the first pixel unit columns, the first sub-pixel rows and the second sub-pixel rows of at least two of the plurality of first pixel units are alternately arranged. Two closest first sub-pixel rows of the first sub-pixel rows of the plurality of first pixel units are respectively located in two adjacent ones of the first pixel unit columns and are staggered from each other in the first direction. The driving method includes: in the light-collecting mode, controlling at least the second sub-pixel row in each of the plurality of first pixel units to be lit up; and in the display mode, controlling the plurality of first pixel units to be lit up.

BRIEF DESCRIPTION OF DRAWINGS

In order to more clearly illustrate the technical solutions in the embodiments of the present disclosure or the related art, the accompanying drawings used in the embodiments or the related art are briefly described below. The drawings described below are merely some embodiments of the present disclosure. Based on these drawings, those of ordinary skill in the art can obtain other drawings.

DESCRIPTION OF EMBODIMENTS

In order to better understand technical solutions of the present disclosure, the embodiments of the present disclosure are described in details with reference to the drawings.

It should be clear that the described embodiments are merely part of the embodiments of the present disclosure rather than all of the embodiments. Those skilled in the art can obtain other embodiments.

The terms used in the embodiments of the present disclosure are merely for the purpose of describing particular embodiments and not intended to limit the present disclosure. Unless otherwise noted in the context, the singular form expressions "a", "an", "the" and "said" used in the embodiments and appended claims of the present disclosure are also intended to represent a plural form.

It should be understood that the term "and/or" as used herein is merely an association describing the associated object, indicating that there may be three relationships. For example, A and/or B may indicate three cases: A alone; A and B; B alone. In addition, a character "/" herein generally indicates that the contextual objects are in an "or" relationship.

It should be understood that although the terms first, second, third, etc. can be used to describe pixel units in the embodiments of the present disclosure, these pixel units should not be limited to these terms. These terms are only used to distinguish pixel units located in different areas from each other. For example, without departing from the scope of the embodiments of the present disclosure, the first pixel unit can also be referred to as the second pixel unit, and similarly, the second pixel unit can also be referred to as the first pixel unit.

Figure 1:
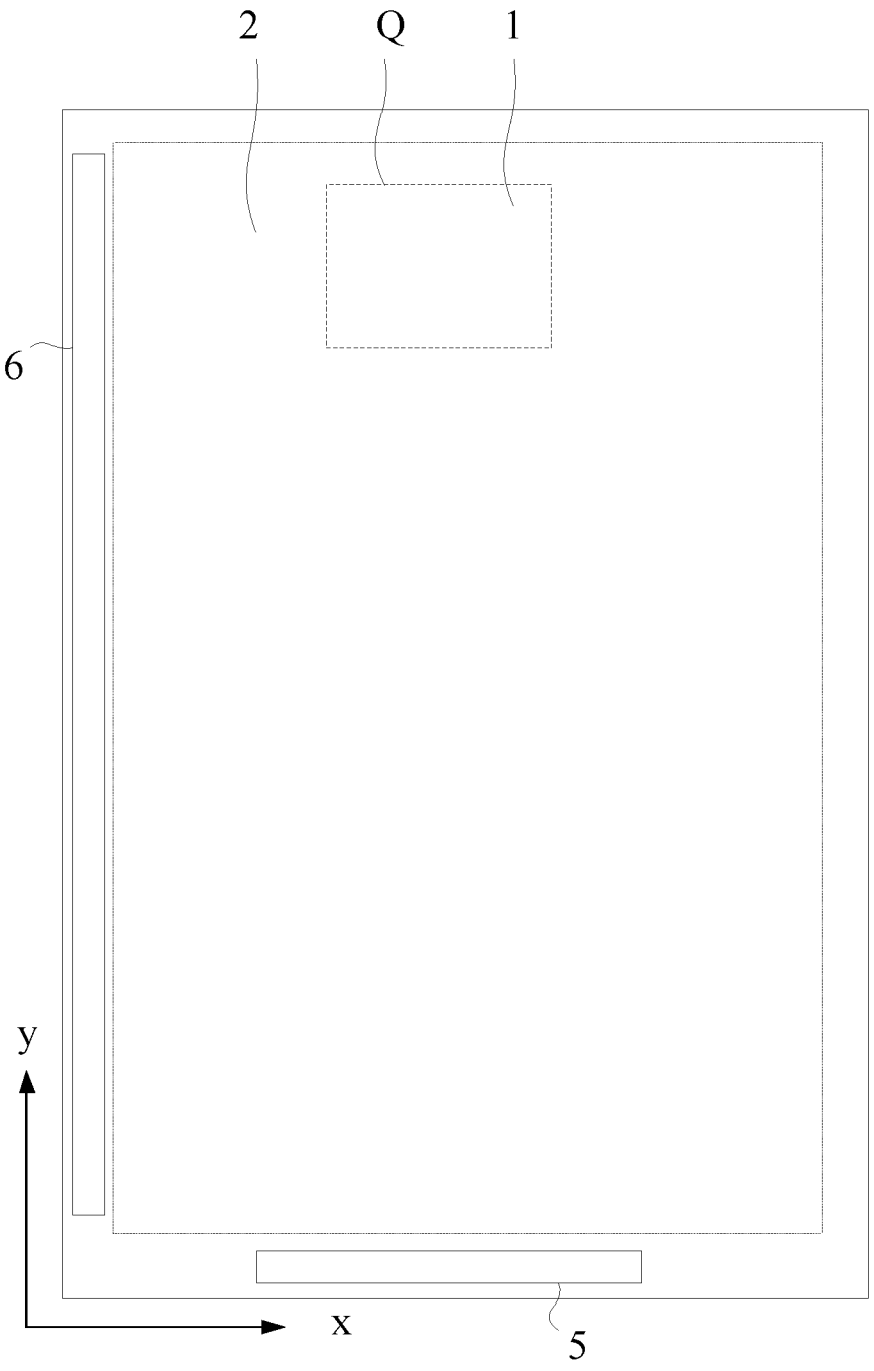
FIG. 1 is a schematic diagram of a display panel provided by an embodiment of the present disclosure.
Figure 2:
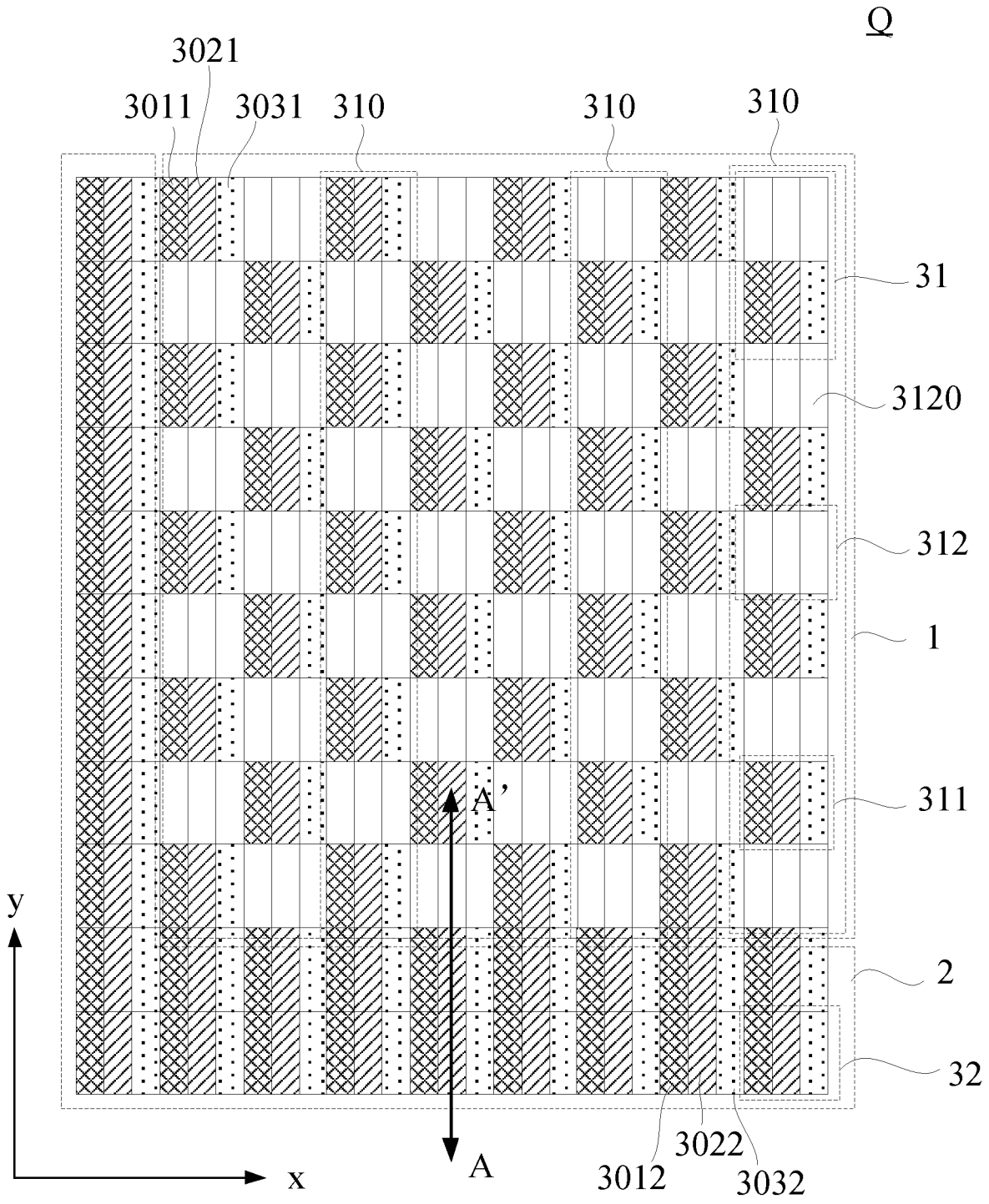
FIG. 2 is an enlarged schematic diagram of an area Q in FIG. 1.

An embodiment of the present disclosure provides a display panel. FIG. 1 is a schematic diagram of a display panel provided by an embodiment of the present disclosure, and FIG. 2 is an enlarged schematic diagram of an area Q in FIG. 1. As shown in FIG. 1 and FIG. 2, the display panel has a first display area 1 and a second display area 2. The second display area 2 at least partially surrounds the first display area 1. In the embodiment of the present disclosure, the second display area 2 can be provided to completely surround the first display area 1 as shown in FIG. 1. In an embodiment, the second display area 2 can also surround a half of the first display area 1.

A plurality of first pixel units 31 is provided in the first display area 1. Exemplarily, the plurality of the first pixel units 31 can be arranged in an array along a first direction x and a second direction y in the first display area 1. The first direction x and the second direction y intersect. A plurality of second pixel units 32 is provided in the second display area 2. The plurality of the second pixel units 32 can be arranged in an array along the first direction x and the second direction y in the second display area 2.

In an embodiment of the present disclosure, a density of the first pixel unit 31 is smaller than a density of the second pixel unit 32. The density of the pixel unit (i.e., Pixels Per Inch, PPI for short) is the number of the pixel units per inch of length in the display panel. The density of the first pixel units 31 is the number of the first pixel units 31 per inch of length in the first display area 1, and the density of the second pixel units 32 is the number of the second pixel units 32 per inch of length in the second display area 2.

As shown in FIG. 2, the first pixel unit 31 includes a first sub-pixel row 311 and a second sub-pixel row 312, and the first sub-pixel row 311 includes a plurality of sub-pixels of different colors arranged along the first direction x. In FIG. 2, a case where the first sub-pixel row 311 includes a first-color sub-pixel 3011, a second-color sub-pixel 3021, and a third-color sub-pixel 3031 is taken as an example. In an embodiment, the first color can be red, the second color can be green, and the third color can be blue.

The second sub-pixel row 312 includes first high-transmittance sub-pixels 3120. The light transmittance of the first high-transmittance sub-pixel 3120 is greater than the light transmittance of the first-color sub-pixel 3011, the light transmittance of the second-color sub-pixel 3021, and the light transmittance of the third-color sub-pixel 3031. In an embodiment, the first high-transmittance sub-pixel 3120 can be a white sub-pixel that emits white light.

In an embodiment of the present disclosure, in one of the first pixel units 31, the number of sub-pixels in the first sub-pixel row 311 is equal to the number of sub-pixels in the second sub-pixel row 312. As shown in FIG. 2, one first pixel unit 31 includes three first high-transmittance sub-pixels 3120, one first-color sub-pixel 3011, one second-color sub-pixel 3021, and one third-color sub-pixel 3031. In the first pixel unit 31, the first sub-pixel row 311 and the second sub-pixel row 312 are arranged along the second direction y.

The second pixel unit 32 includes a plurality of sub-pixels of different colors. Types of colors of the sub-pixels included in the second pixel unit 32 can be the same as types of the colors of the sub-pixels included in the first sub-pixel row 311. In FIG. 2, the same filling pattern represents the sub-pixels of the same color. As shown in FIG. 2, the second pixel unit 32 also includes a first-color sub-pixel, a second-color sub-pixel, and a third-color sub-pixel. To distinguish, the first-color sub-pixel in the second pixel unit 32 is marked as 3012, the second-color sub-pixel in the second pixel unit 32 is marked as 3022, and the third-color sub-pixel in the second pixel unit 32 is marked as 3032.

In an embodiment of the present disclosure, first high-transmittance sub-pixels can also be provided in the second pixel unit 32, in order to increase the brightness of the second display area 2 and lower power consumption of the display panel when the second display area 2 displays. In an embodiment, the second pixel unit 32 is not provided with first high-transmittance sub-pixels, in order to increase the density of the second pixel unit 32 in the second display area 2 when sizes of various sub-pixels are constant, making a display image in the second display area 2 more delicate. FIG. 2 is a schematic diagram showing that no first high-transmittance sub-pixels is provided in the second pixel unit 32.

Continuing to refer to FIG. 2, in the first display area 1, a plurality of the first pixel units 31 are arranged along the second direction y to form a first pixel unit column 310, a plurality of the first pixel unit columns 310 are arranged along the first direction x; in one first pixel unit column 310, the first sub-pixel rows 311 and the second sub-pixel rows 312 are alternately arranged; and two closest first sub-pixel rows 311 that are located in two adjacent first pixel unit columns 310 are staggered from each other in the first direction x. As shown in FIG. 2, along the first direction x, two first sub-pixel rows 311 that belong to two adjacent first pixel unit columns 310 and are closest do not overlap with each other.

In an embodiment, the display panel provided by the embodiment of the present disclosure can be a liquid crystal display panel. Each of the sub-pixels above includes a pixel electrode, a common electrode, a thin film transistor (TFT), and a color filter (CF) of a corresponding color. The display panel further includes scanning lines and data lines. The scanning line is electrically connected to a gate of the TFT, the data line is electrically connected to a source of the TFT, and the pixel electrode is electrically connected to a drain of the TFT. When the sub-pixel is lit, the TFT of the sub-pixel is turned on. A data voltage required for the sub-pixel to be lit up is applied to the corresponding pixel electrode through the data line. An electric field is formed between the pixel electrode and the common electrode. Under the electric field formed between the pixel electrode and the common electrode, the liquid crystal is deflected, to adjust the intensity of the light emitted from the display panel. The light is emitted through the color filter of the corresponding color, enabling the display panel to realize full-color display. The pixel electrode and the TFT are located in an array substrate of the display panel, and the color filter is located in a color film substrate. The common electrode can be located in the color film substrate or in the array substrate, and its position can be set according to a display mode of the display panel, which is not limited in the embodiment of the present disclosure.

Figure 3:
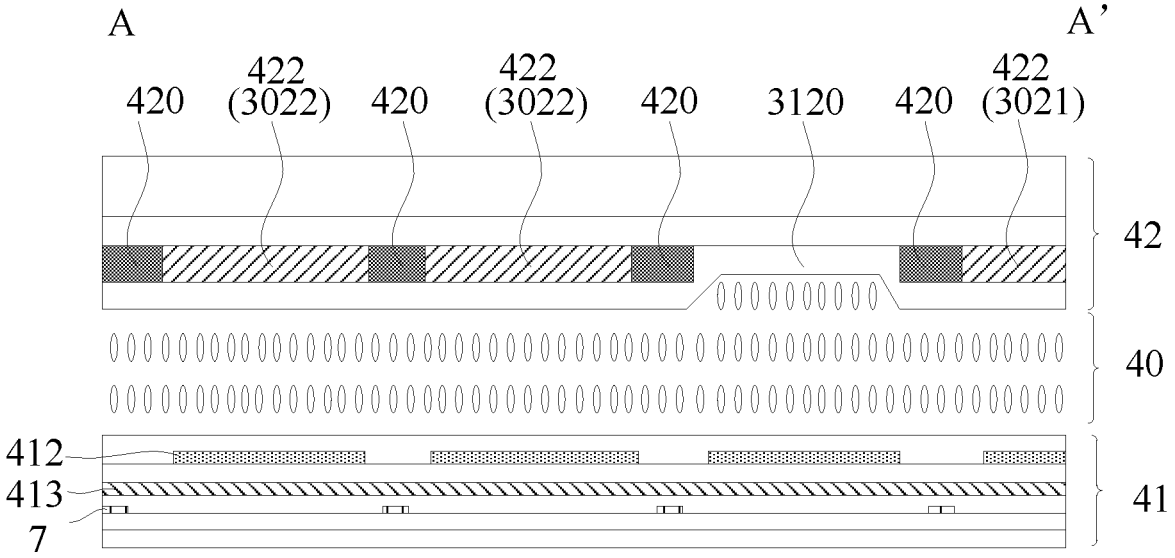
FIG. 3 is a schematic cross-sectional diagram taken along AA' in FIG. 2.

FIG. 3 is a schematic cross-sectional diagram along AA' in FIG. 2. In an embodiment, as shown in FIG. 3, the display panel includes an array substrate 41, a color film substrate 42 opposite to the array substrate 41, and a liquid crystal 40 located between the array substrate 41 and the color film substrate 42. The array substrate 41 is further provided with a scanning line 7, a pixel electrode 412, a data line (not shown in FIG. 3), and a TFT (not shown in FIG. 3). The color film substrate 42 is provided with a black matrix (BM) 420 and a plurality of color filters, such as a first-color filter (not shown in FIG. 3), a second-color filter 422, and a third-color filter (not shown in FIG. 3). In the color film substrate 42, the color filter can not be provided at a position corresponding to the first high-transmittance sub-pixel 3120. In an embodiment, a transparent film layer can be provided at the position corresponding to the first high-transmittance sub-pixel 3120. An orthographic projection of the black matrix 420 on a plane of the display panel covers opaque structures such as the scanning line, the data line, and the TFT. As shown in FIG. 3, the orthographic projection of the black matrix 420 on the plane of the display panel covers the scanning line 7. In FIG. 3, a case where the common electrode 413 is provided on a side of the array substrate 41 is exemplarily illustrated.

According to functions of the display panel, an embodiment of the present disclosure can be provided with a corresponding light-collecting module corresponding to the first display area 1 of the display panel. The light-collecting module can be arranged on a side of the array substrate 41 facing away from the color film substrate 42. For example, the light-collecting module can include a camera module or a fingerprint recognition module. Correspondingly, working modes of the display panel provided by an embodiment of the present disclosure can include a display mode and a light-collecting mode:

In the light-collecting mode, at least the second sub-pixel row 312 in the first pixel unit 31 is controlled to be lit up. When the first high-transmission sub-pixel 3120 in the second sub-pixel row 312 is lit, a deflection angle of the liquid crystal corresponding to the first high-transmission sub-pixel 3120 allows light to pass. For example, when the light-collecting module is a camera module, the light-collecting mode can be a camera mode in which the camera module is turned on. In the camera mode, ambient light can enter the camera module provided corresponding to the first display area 1 through the liquid crystal 40 in an area where the first high-transmittance sub-pixel 3120 is located. When the light-collecting module is the fingerprint recognition module, after light emitted by a fingerprint recognition light source is reflected by a finger on a light emission side of the display panel, reflected light can enter the fingerprint recognition module provided corresponding to the first display area 1 through the liquid crystal 40 in the area where the first high-transmittance sub-pixel 3120 is located.

In the display mode, the first pixel unit 31 and the second pixel unit 32 are controlled to be lit up so that both the first display area 1 and the second display area 2 can be used for display. When the first display area 1 is used for display, the first display area 1 and the second display area 2 can jointly display a complete image. In an embodiment, the first display area 1 and the second display area 2 can display independently. For example, the first display area 1 can be used to display information such as date, time, and call reminder.

It can be seen that in the embodiment of the present disclosure, the first display area 1 can not only transmit light to meet light collecting requirements of the light-collecting modules such as the camera module or the fingerprint recognition module, but also perform normal image display. That is, the first display area 1 can have both display and light collecting functions, which enriches user experiences while also increasing a screen-to-body ratio of the display panel.

In the embodiment of the present disclosure, the first high-transmittance sub-pixels 3120 are provided in the first display area 1 and the density of the first pixel unit 31 is lower than the density of the second pixel unit 32, which can increase the light transmittance of the first display area 1 and then increase the light intensity of light entering the light-collecting module provided corresponding to the first display area 1. When the light-collecting module is the camera module, such configuration can improve a camera effect of the camera module. When the light-collecting module is the fingerprint recognition module, such configuration can improve recognition sensitivity of the fingerprint recognition module.

In the first display area 1, the embodiment of the present disclosure makes two first sub-pixel rows 311 that belong to two adjacent first pixel unit columns 310 and are closest be staggered from each other in the first direction x. For example, in the first direction x, the first sub-pixel row 311 and the second sub-pixel row 312 including the first high-transmittance sub-pixels 3120 can be alternately arranged, to avoid the plurality of the first sub-pixel rows 311 from being continuously arranged in the first display area 1, and to avoid the plurality of the second sub-pixel rows 312 from being continuously arranged in the first display area 1. When the first display area 1 displays, in a case where at least some of the sub-pixels in the first sub-pixel row 311 are lit and the first high-transmittance sub-pixel 3120 in the second sub-pixel row 312 is not lit, the arrangement provided in the embodiment of the present disclosure can prevent dark spots formed by the first high-transmittance sub-pixels 3120 from being continuously arranged in the first display area 1, to avoid that the dark spots formed by the first high-transmittance sub-pixels 3120 are too concentrated to cause human eyes to observe obvious dark lines. Moreover, such arrangement can also prevent bright spots formed by the first sub-pixel rows 311 from being continuously arranged in the first display area 1, to avoid that the bright spots formed by the first sub-pixel row 311 are too concentrated to cause the human eyes to observe obvious color fringing. That is, the arrangement in the embodiment of the present disclosure can also ensure the first display area 1 to have a higher light transmittance and cause the first display area 1 to have a better display effect while enabling the first display area 1 to have both display and lighting functions to enrich the user experience and increase the screen-to-body ratio of the display panel.

Figure 4:
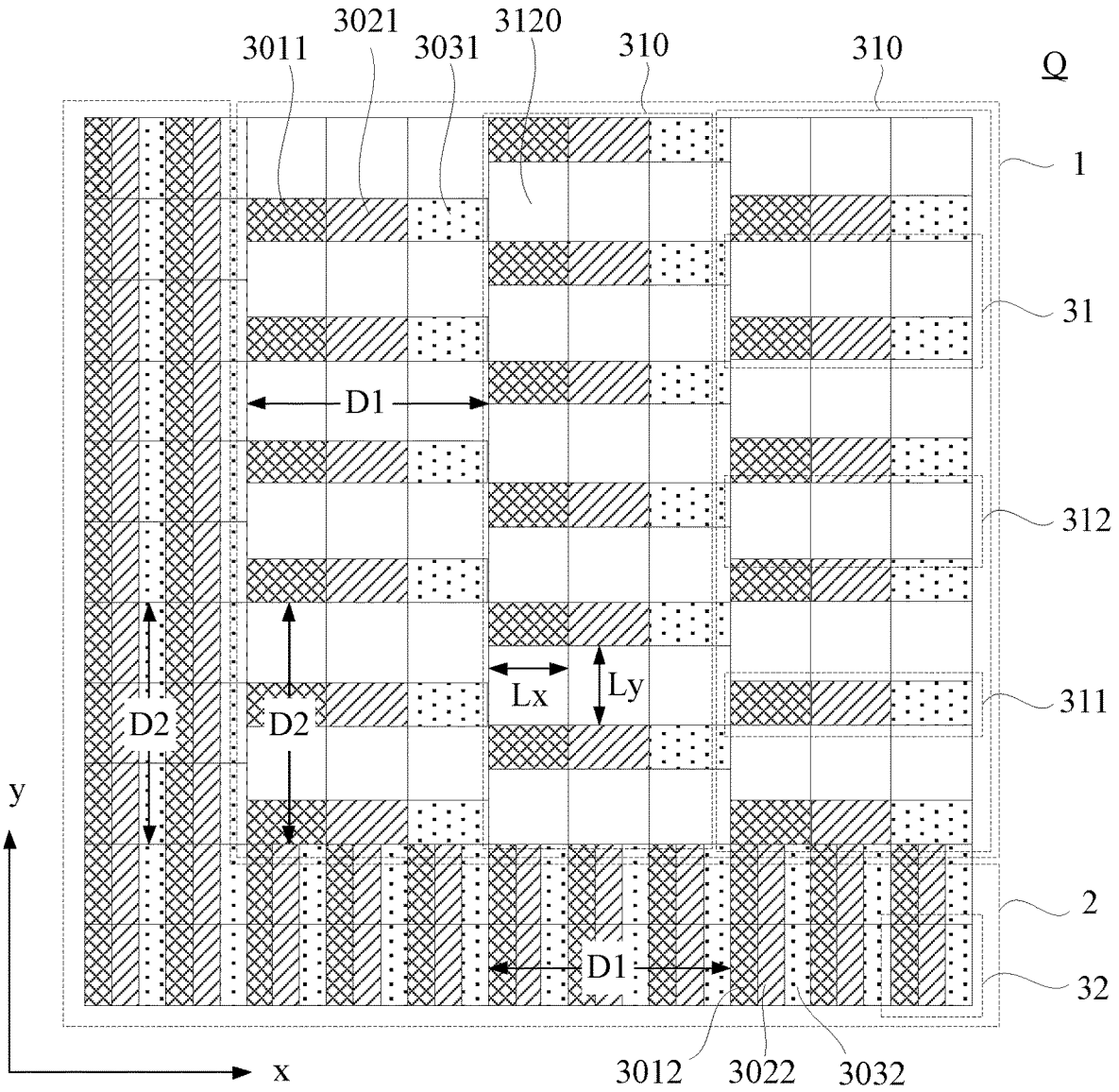
FIG. 4 is another enlarged schematic diagram of an area Q in FIG. 1.

FIG. 4 is another enlarged schematic diagram of the area Q in FIG. 1. Exemplarily, when providing the first pixel unit 31, as shown in FIG. 4, an area of at least one first high-transmittance sub-pixel 3120 in the first pixel unit 31 is larger than an area of a single sub-pixel in the second pixel unit 32, which improves the light transmittance of the first display area 1.

In an embodiment, in order to increase the area of the first high-transmittance sub-pixel 3120, a length Lx of the first high transmittance sub-pixel 3120 along the first direction x is greater than a length of each sub-pixel in the second pixel unit 32 along the first direction x. In an embodiment, in order to increase the area of the first high-transmittance sub-pixel 3120, a length Ly of the first high-transmittance sub-pixel 3120 in the second direction y is greater than a length of each sub-pixel in the second pixel unit 32 in the second direction y. In an embodiment, in order to increase the area of the first high-transmittance sub-pixel 3120, a length Lx of the high transmittance sub-pixel 3120 along the first direction x is greater than a length of each sub-pixel in the second pixel unit 32 along the first direction x, and a length Ly of the first high-transmittance sub-pixel 3120 in the second direction y is greater than a length of each sub-pixel in the second pixel unit 32 in the second direction y. FIG. 4 is a schematic diagram showing that the length Lx of the first high-transmittance sub-pixel 3120 along the first direction x is greater than a length of a single sub-pixel in the second pixel unit 32 along the first direction x.

In an embodiment of the present disclosure, as shown in FIG. 4, the area of sub-pixel of a single color in the first sub-pixel row 311 is smaller than the area of the first high-transmittance sub-pixel 3120 in one first pixel unit 31, which ensures fineness of the image displayed in the first display area 1 while increasing the light transmittance of the first display area 1. In an embodiment of the present disclosure, in order to reduce an area of each sub-pixel in the first sub-pixel row 311, the length of the sub-pixel of a single color in the first sub-pixel row 311 along the first direction x is smaller than the length Lx of the first high-transmittance sub-pixel 3120 along the first direction x. In an embodiment, in order to reduce an area of each sub-pixel in the first sub-pixel row 311, the length of the sub-pixel of each color in the first sub-pixel row 311 in the second direction y is smaller than the length Ly of the first high-transmittance sub-pixel 3120 in the second direction y. In an embodiment, in order to reduce an area of each sub-pixel in the first sub-pixel row 311, the length of the sub-pixel of a single color in the first sub-pixel row 311 along the first direction x is smaller than the length Lx of the first high-transmittance sub-pixel 3120 along the first direction x, and the length of the sub-pixel of each color in the first sub-pixel row 311 in the second direction y is smaller than the length Ly of the first high-transmittance sub-pixel 3120 in the second direction y. FIG. 4 is a schematic diagram showing that the length of a single sub-pixel in the first sub-pixel row 311 along the second direction y is smaller than the length Ly of the first high-transmittance sub-pixel 3120 along the second direction y. As shown in FIG. 4, a plane perpendicular to the first direction x is defined as a projection plane, and the first high-transmittance sub-pixel 3120 at least partially overlaps the first sub-pixel row 311 in the adjacent first pixel unit column 310, that is, the orthographic projection of the first high-transmittance sub-pixel 3120 on the projection plane at least partially overlaps the orthographic projection of the first sub-pixel row 311 in the adjacent first pixel unit column 310 on the projection plane.

Illustratively, in one first pixel unit 31, two sub-pixels that are respectively located in the first sub-pixel row 311 and the second sub-pixel row 312 are adjacent to each other along the second direction y and aligned with each other. Taking FIG. 2 and FIG. 4 as an example, as for three first high-transmittance sub-pixels 3120 in the second sub-pixel row 312, the three first high-transmission sub-pixels 3120 are respectively aligned with the first-color sub-pixel 3011, the second-color sub-pixel 3021, and the third-color sub-pixel 3031 in the adjacent first sub-pixel row 311. For example, as shown in FIGS. 2 and 4, in one first pixel unit 31, along the first direction x, the length Lx of the first high-transmittance sub-pixel 3120 is equal to the lengths of the first-color sub-pixel 3011, the second-color sub-pixel 3021, and the third-color sub-pixel 3031 that are located in the adjacent first sub-pixel row 311, so that the first high-transmittance sub-pixel 3120 is aligned with its adjacent color sub-pixels.

When providing the data lines located in the first display area 1, three data lines can be provided corresponding to the first pixel unit 31: a first data line of the three data lines connects the first-color sub-pixel 3011 and the first high-transmittance sub-pixel 3120 adjacent thereto, a second data line of the three data lines connects the second-color sub-pixel 3021 and the first high-transmittance sub-pixel 3120 adjacent thereto, and a third data line of the three data lines connects the third-color sub-pixel 3031 and the first high-transmittance sub-pixel 3120 adjacent thereto. The first high-transmittance sub-pixel 3120 is aligned with its adjacent color sub-pixel, and the three data lines can be as arranged in a straight line to avoid winding of the data lines. With such configuration, in one aspect, the length of the data line can be shortened, to reduce an adverse effect of signal delay on the display of the first display area. In another aspect, since a black matrix is provided to cover the data line, and the area of the black matrix can be reduced when the length of the data line is reduced, which is beneficial to increase an aperture ratio of the sub-pixel.

In an embodiment of the present disclosure, the density PPI1 of the first pixel unit 31 satisfies 100<PPI1<300. The embodiment of the present disclosure, by setting PPI1<300, the light transmittance of the first display area 1 can be ensured, and a light collecting effect of the light-collecting module can be ensured. The embodiment of the present disclosure, by setting PPI1>100, a pixel pitch between adjacent first pixel units 31 is not too large, such that when the first display area 1 displays, the fineness of the display image of the first display area 1 can be ensured.

In an embodiment, the density PPI2 of the second pixel unit 32 satisfies PPI2>300, so that the second display area 2 can display a more delicate image.

In an embodiment of the present disclosure, along the first direction x, the number of the first pixel units 31 in a unit length of the first pixel units 31 in the same row is a1, and the number of the second pixel units 32 in a unit length of the second pixel units 32 in the same row is b1; along the second direction y, the number of the first pixel units 31 in the unit length of the first pixel units 31 in the same column is a2, and the number of the second pixel units 32 in the unit length of the second pixel units 32 in the same column is b2. In an embodiment, a1 and b1 can satisfy: 1:4<a1:b1<1. In an embodiment, a2 and b2 can satisfy: 1:4<a2:b2<1. In an embodiment, a1 and b1 can satisfy: 1:4<a1:b1<1, and a2 and b2 can satisfy: 1:4<a2:b2<1. With such configuration, it can be ensured that the density of the first pixel unit 31 is smaller than the density of the second pixel unit 32, and the density PPI1 of the first pixel unit 31 can satisfy 100<PPI1<300.

As shown in FIG. 4, a case where D1 is a unit length in the first direction x and D2 is a unit length in the second direction y is illustrated, the number a1 of the first pixel units 31 in the unit length D1 of the first pixel units 31 in the same row is 1, and the number b1 of the second pixel units 32 in the unit length D1 of the second pixel units 32 in the same row is 3. That is, a1:b1=1:3. The number a2 of the first pixel units 31 in the unit length D2 of the first pixel units 31 in the same column is 2, and the number b2 of second pixel units 32 in the unit length D2 of the second pixel units 32 in the same column is 3. That is, a2:b2=2:3. Based on the pixel design shown in FIG. 4, the PPI1 of the first display area 1 can be set to 211.

Figure 5:
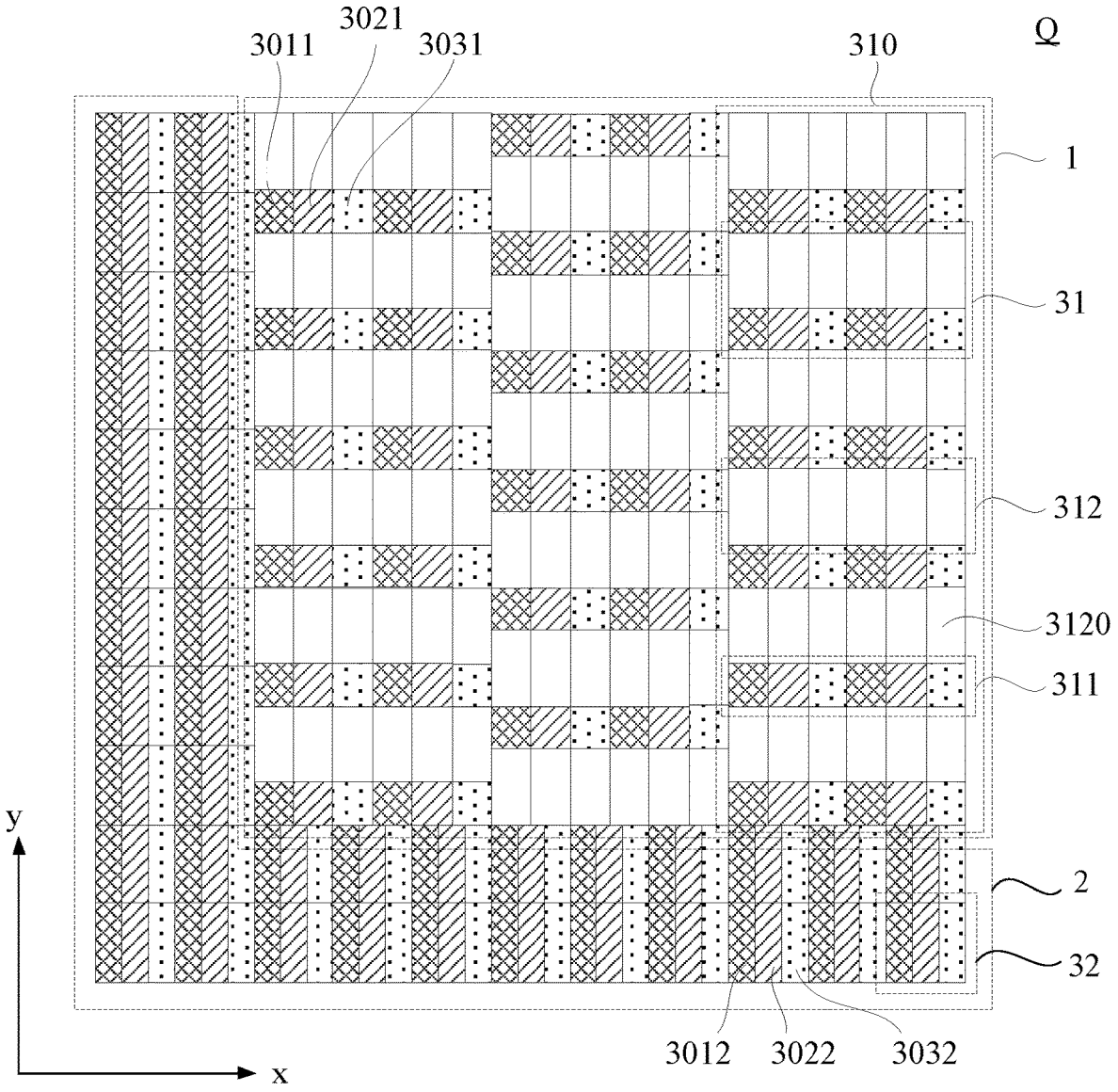
FIG. 5 is another enlarged schematic diagram of an area Q in FIG. 1.

FIG. 5 is another enlarged schematic diagram of the area Q in FIG. 1. In an embodiment, as shown in FIG. 5, a1:b1=2:3 and a2:b2=2:3. Based on the pixel design shown in FIG. 5, the PPI1 of the first display area 1 can be set to 267.

Figure 6:
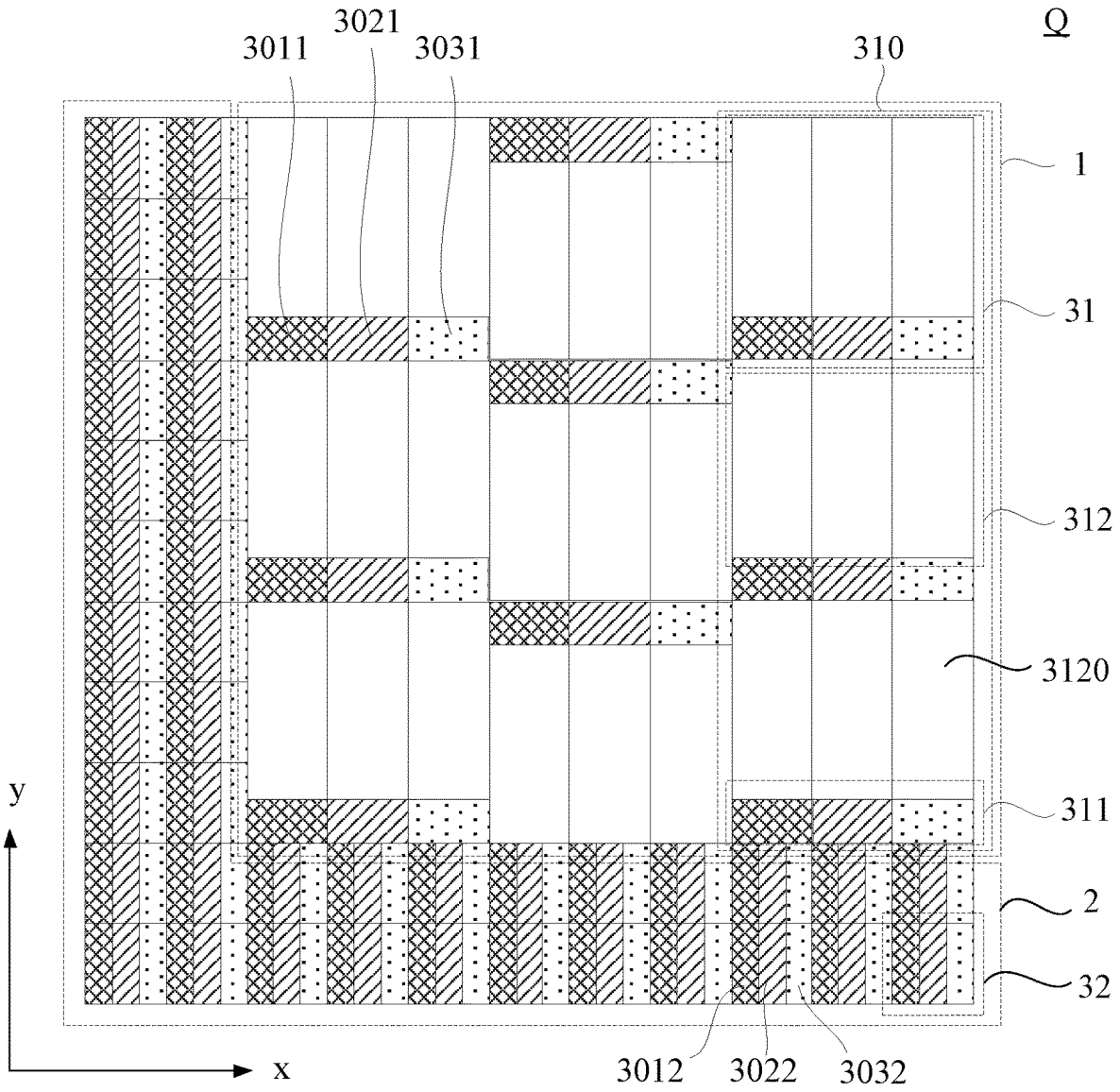
FIG. 6 is another enlarged schematic diagram of an area Q in FIG. 1.

FIG. 6 is another enlarged schematic diagram of the area Q in FIG. 1. In an embodiment, as shown in FIG. 6, a1:b1=1:3 and a2:b2=1:3. Based on the pixel design shown in FIG. 6, the PPI1 of the first display area 1 can be set to 141.

Figure 7:
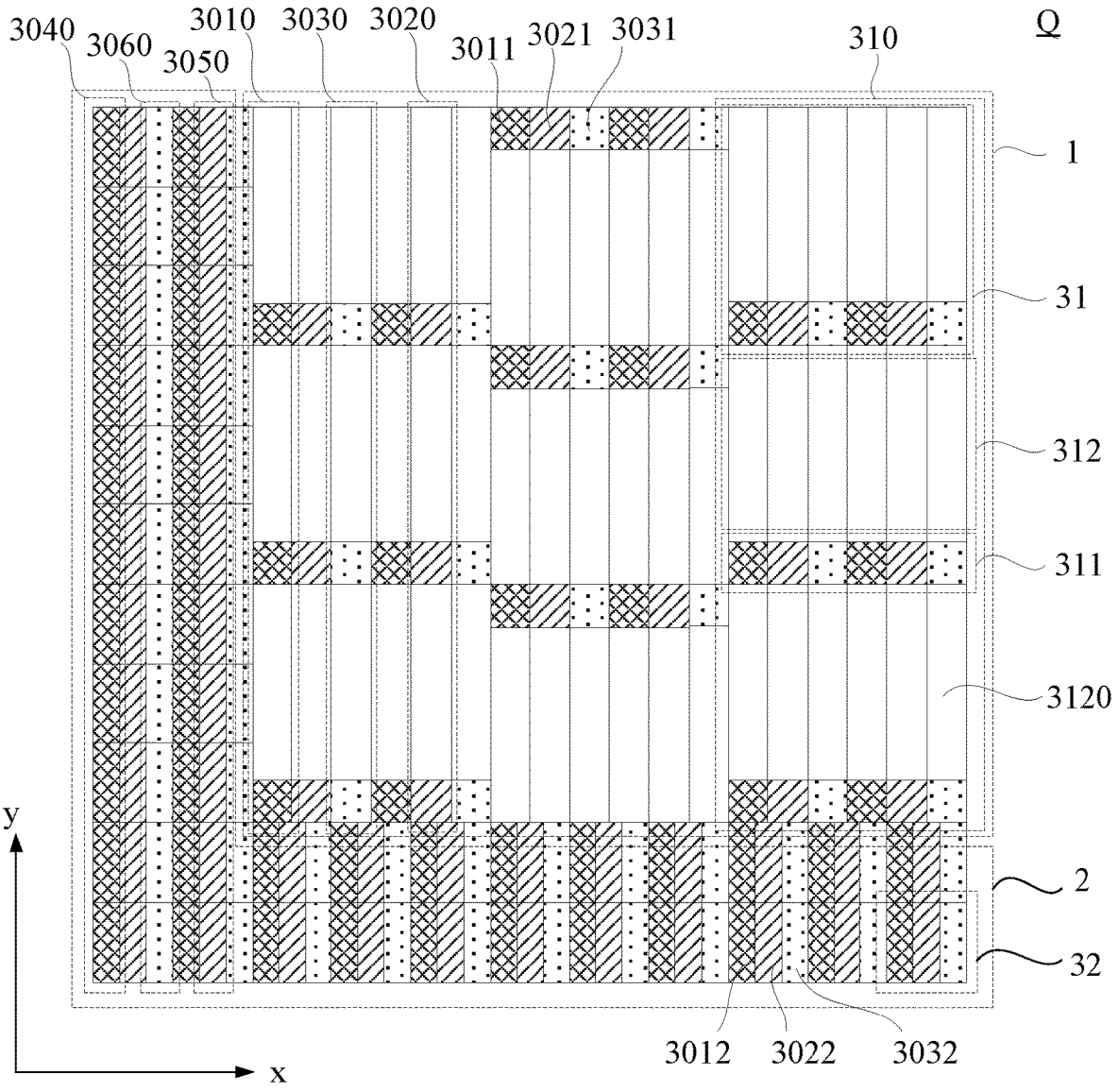
FIG. 7 is another enlarged schematic diagram of an area Q in FIG. 1.

FIG. 7 is another enlarged schematic diagram of the area Q in FIG. 1. In an embodiment, as shown in FIG. 7, a1:b1=2:3 and a2:b2=1:3. Based on the pixel design shown in FIG. 7, the PPI1 of the first display area 1 can be set to 211.

It should be noted that the pixel designs shown in FIG. 4, FIG. 5, FIG. 6, and FIG. 7 are only exemplary descriptions of the embodiments of the present disclosure, and in practice, on the basis that the PPI1 of the first display area 1 satisfies 100<PPI1<300, a1:b1 and a2:b2 can be designed as combinations of other different values, which will not be repeated in the embodiments of the present disclosure.

In an embodiment, in order to make a1:b1<1, that is, to make the number of the first pixel units 31 in the unit length of the first pixel units 31 of the same row smaller than the number of the second pixel units 32 in the unit length of the second pixel units 32 in the same row, as shown in FIGS. 4, 5, 6 and 7, the length Lx of the first high-transmittance sub-pixel 3120 along the first direction x can be set to be relatively large, such that the length Lx of the first high-transmittance sub-pixel 3120 along the first direction x is greater than the length of a single sub-pixel in the second pixel unit 32 along the first direction x. Correspondingly, when the length of the first high-transmittance sub-pixel 3120 along the first direction x is the same as the length of the adjacent sub-pixel in the first pixel unit 31 along the first direction x, as shown in FIGS. 4, 5, 6 and 7, the length of the first-color sub-pixel 3011 in the first display area 1 along the first direction x is greater than the length of the first-color sub-pixel 3012 in the second display area 2 along the first direction x. The length of the second-color sub-pixel 3021 in the first display area 1 along the first direction x is greater than the length of the second-color sub-pixel 3022 in the second display area 2 along the first direction x. The length of the third-color sub-pixel 3031 in the first display area 1 along the first direction x is greater than the length of the third-color sub-pixel 3032 in the second display area 2 along the first direction x.

In order to satisfy a2:b2<1, that is, to make the number of the first pixel units 31 in the unit length of the first pixel units 31 in the same column smaller than the number of the second pixel units 32 in the unit length of the second pixel units 32 in the same column, as shown in FIG. 4, FIG. 5, FIG. 6 and FIG. 7, a sum of the length Ly of the first high transmittance sub-pixel 3120 along the second direction y and the length of the first sub-pixel row 311 along the second direction y can be greater than the length of a single sub-pixel in the second pixel unit 32 along the second direction y.

In a manufacturing process of the liquid crystal display panel, as shown in FIG. 3 in combination, the color film substrate 42 and the array substrate 41 are usually manufactured first. Then, sealant is coated on one side of the color film substrate 42 and the array substrate 41, and liquid crystals 40 are dripped on the other side. After that, the array substrate 41 and the color film substrate 42 are bound together to seal the liquid crystal 40 between them to form a liquid crystal cell. In other words, a distance between a surface of the color film substrate 42 facing towards the array substrate 41 and a surface of the array substrate 41 facing towards the color film substrate 42 determines a thickness of the liquid crystal layer. Generally, in the surface of the array substrate 41 facing towards the color film substrate 42, when the first high-transmittance sub-pixel 3120 is a white sub-pixel, that is, when a position where the white sub-pixel 3120 in the color film substrate 42 is located is not provided with a color filter, a thickness of the layer in a region corresponding to the white sub-pixel 3120 in the color film substrate 42 is smaller than a thickness of the layer in other positions. After forming the cell, compared with the second display area 2, the liquid crystal will be more concentrated in the first display area 1 including the white sub-pixel 3120, and a cell thickness of the first display area 1 is greater than a cell thickness of the second display area 2, so that long-wavelength light, such as red and green wavelength light, passes through the first high-transmittance sub-pixels 3120 more, then the first display area 1 has a yellowish chromaticity problem when displaying white points.

Figure 8:
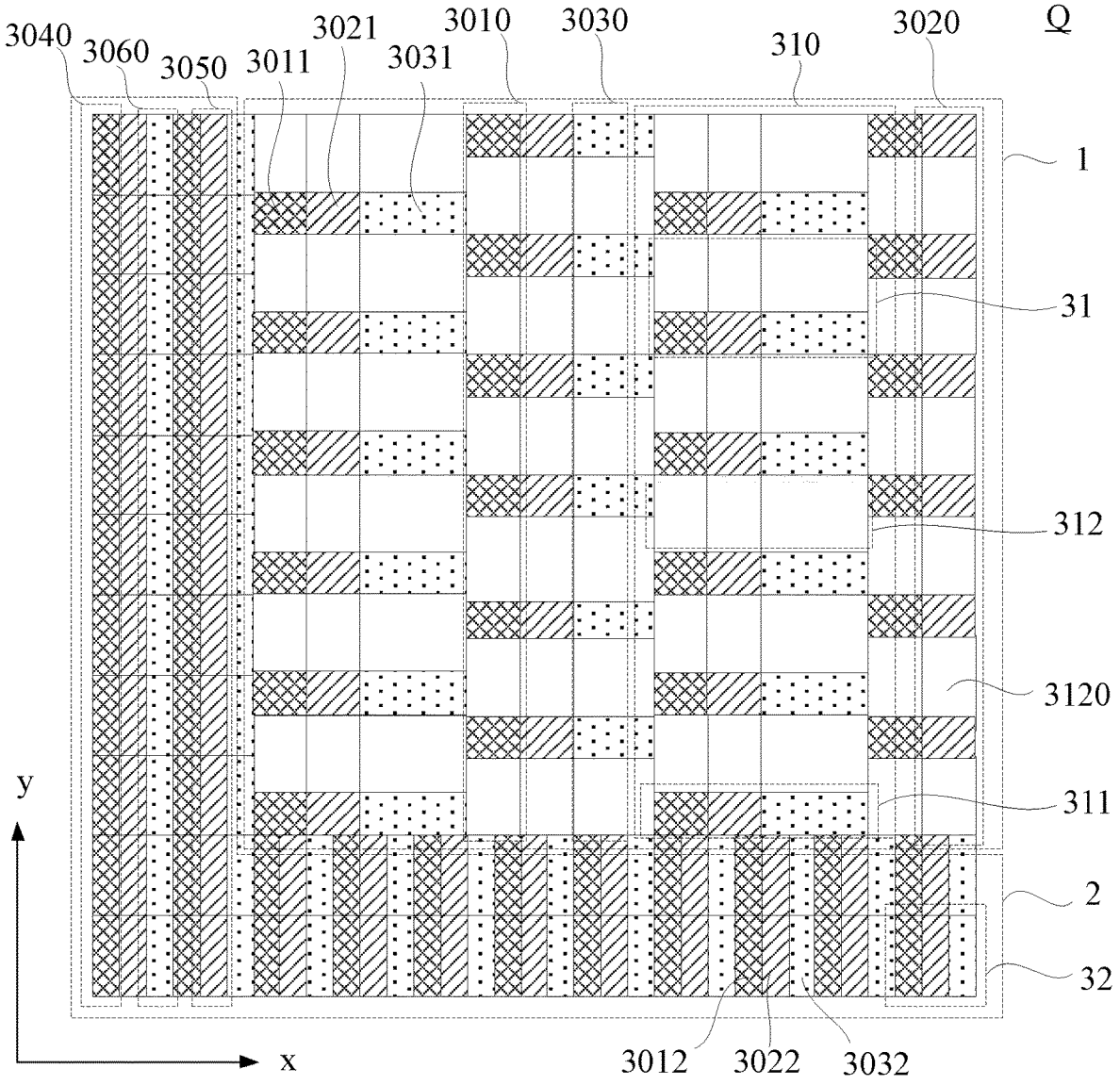
FIG. 8 is another enlarged schematic diagram of an area Q in FIG. 1.

In an embodiment of the present disclosure, when the first color is red, the second color is green, and the third color is blue, that is, when multiple sub-pixels of different colors include the red sub-pixel, the green sub-pixel, and the blue sub-pixel, an area of at least one of the red sub-pixel or the green sub-pixel is smaller than an area of the blue sub-pixel in the first pixel unit 31. FIG. 8 is another enlarged schematic diagram of the area Q in FIG. 1. As shown in FIG. 8, the area of the red sub-pixel 3011 is equal to the area of the green sub-pixel 3021, and both are smaller than the area of the blue sub-pixel 3031. With such configuration, the intensity of the yellow light emitted after the red and green are mixed can be reduced, so that the yellowish chromaticity problem of the white point in the first display area 1 can be improved.

In an embodiment, to reduce the area of the red sub-pixel 3011, the length of the red sub-pixel 3011 along the first direction x is smaller than the length of the blue sub-pixel 3031 along the first direction x. In an embodiment, to reduce the area of the red sub-pixel 3011, the length of the red sub-pixel 3011 along the second direction y is smaller than the length of the blue sub-pixel 3031 along the second direction y. In an embodiment, to reduce the area of the red sub-pixel 3011, the length of the red sub-pixel 3011 along the first direction x is smaller than the length of the blue sub-pixel 3031 along the first direction x, and the length of the red sub-pixel 3011 along the second direction y is smaller than the length of the blue sub-pixel 3031 along the second direction y. In an embodiment, to reduce the area of the green sub-pixel 3021, the length of the green sub-pixel 3021 along the first direction x is smaller than the length of the blue sub-pixel 3031 along the first direction x. In an embodiment, to reduce the area of the green sub-pixel 3021, the length of the green sub-pixel 3021 in the second direction y is smaller than the length of the blue sub-pixel 3031 in the second direction y. In an embodiment, to reduce the area of the green sub-pixel 3021, the length of the green sub-pixel 3021 along the first direction x is smaller than the length of the blue sub-pixel 3031 along the first direction x, and the length of the green sub-pixel 3021 in the second direction y is smaller than the length of the blue sub-pixel 3031 in the second direction y. In an embodiment, the area of the red sub-pixel 3011 and the area of the green sub-pixel 3021 are reduced, the area of the red sub-pixel 3011 is reduced according to the aforementioned embodiment and will not be repeated herein, and the area of the green sub-pixel 3021 is reduced according to the aforementioned embodiment and will not be repeated herein. FIG. 8 is a schematic diagram where the length of the red sub-pixel 3011 along the first direction x is smaller than the length of the blue sub-pixel 3031 along the first direction x, the length of the green sub-pixel 3021 along the first direction x is smaller than the length of the blue sub-pixel 3031 along the first direction x, and the length of the red sub-pixel 3011 in the second direction y is equal to the length of the green sub-pixel 3021 in the second direction y and equal to the length of the blue sub-pixel 3031 in the second direction y. In this case, as shown in FIG. 8, a1:b1=1:2.5, a2:b2=2:3, so as to make the first display area 1 have a higher light transmittance while improving the yellowish chromaticity problem of the white point in the first display area 1.

Figure 9:
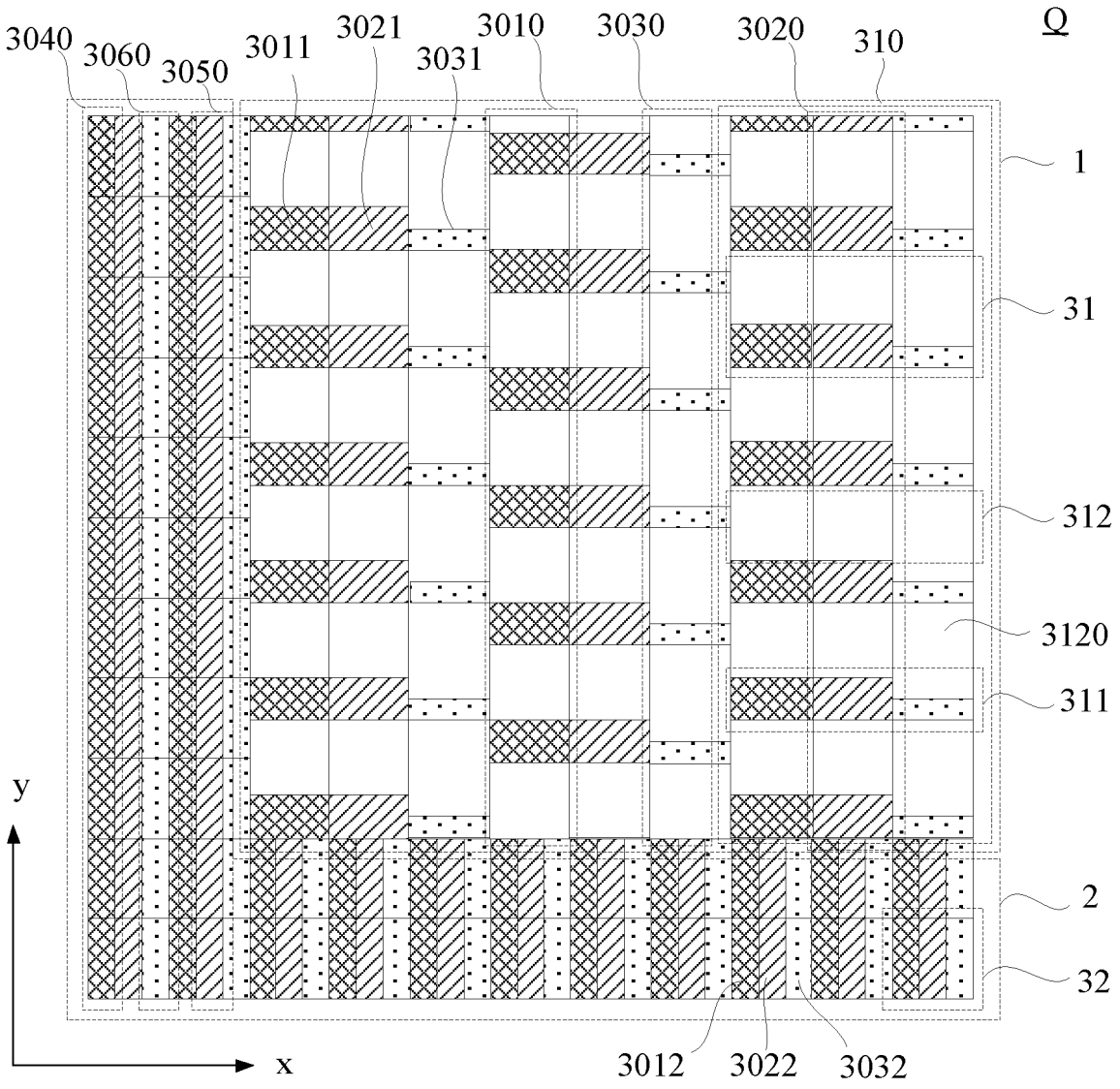
FIG. 9 is another enlarged schematic diagram of an area Q in FIG. 1.

In an embodiment, in the first pixel unit 31, the lengths of the blue sub-pixel 3031 in the first direction x and the second direction y are both smaller than or equal to 65 Since the light transmittance of the blue color filter forming the blue sub-pixel 3031 is low, during display, if the lengths of the blue sub-pixel 3031 in the first direction x and the second direction y are too large, visible dark spots are likely to occur at a position where the blue sub-pixel 3031 is located due to the intensity of the blue light being smaller than the intensity of the red light and the intensity of the green light. The embodiment of the present disclosure, by controlling the lengths of the blue sub-pixel 3031 in the first direction x and the second direction y to be within the range of smaller than or equal to 65 an area of possible dark spots can be reduced, thereby avoiding that the dark spots are observed by the human eye. FIG. 9 is another enlarged schematic diagram of the area Q in FIG. 1 As shown in FIG. 9, on the basis that the area of the first pixel unit 31 is constant, the embodiment of the present disclosure, by reducing the area of the blue sub-pixel 3031, can correspondingly increase the area of the white sub-pixel 3120 arranged adjacent to the blue sub-pixel 3031, so that the light transmittance of the first display area 1 can be improved while avoiding the dark spots visible to the human eye.

Figure 10:
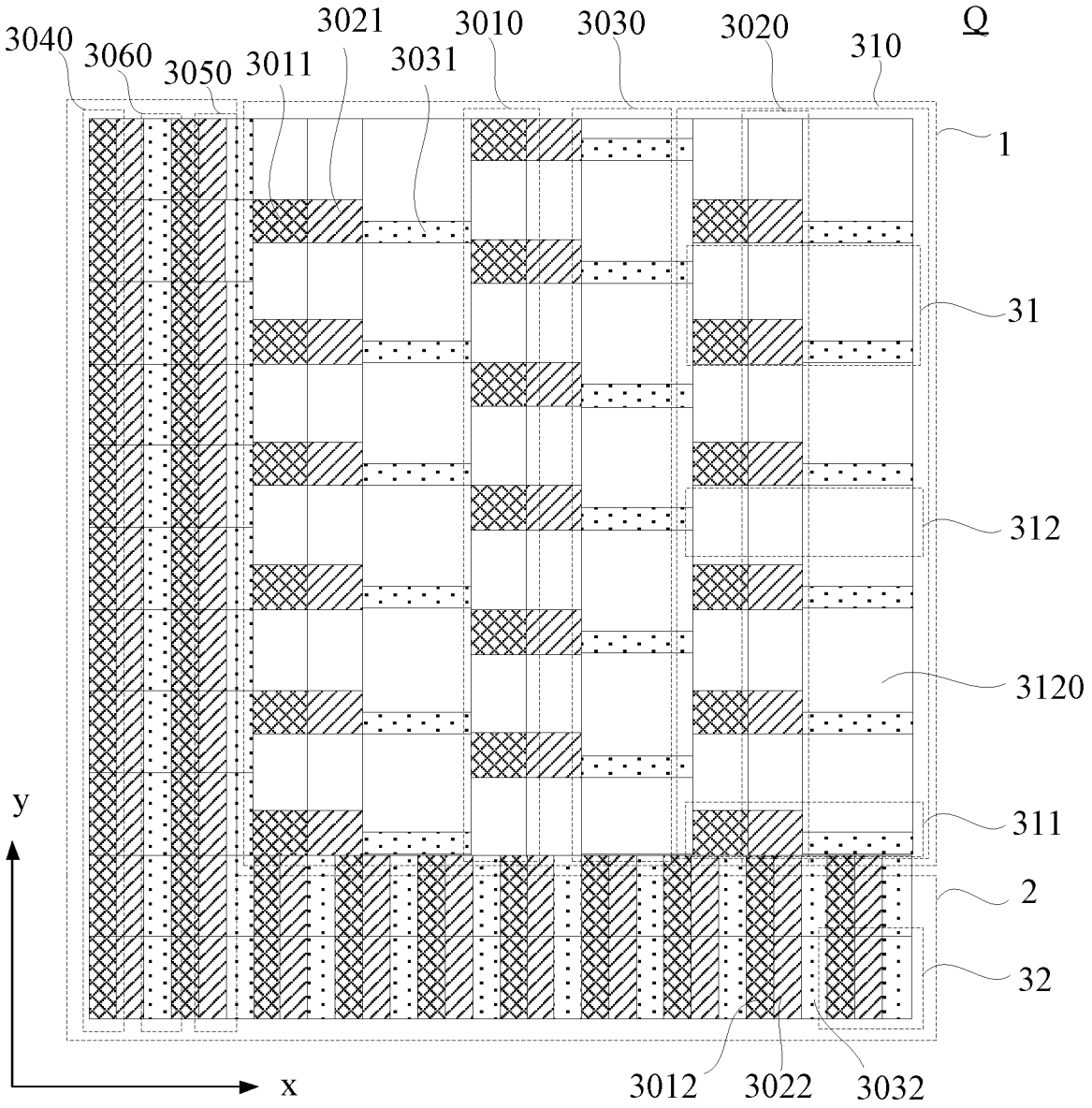
FIG. 10 is another enlarged schematic diagram of an area Q in FIG. 1.

FIG. 10 is another enlarged schematic diagram of the area Q in FIG. 1. Illustratively, as shown in FIG. 10, the area of the red sub-pixel 3011 and the area of the green sub-pixel 3021 are both smaller than the area of the blue sub-pixel 3031, and the lengths of the blue sub-pixel 3031 in the first direction x and the second direction y are both smaller than or equal to 65 μm. With such configuration, the yellowish chromaticity problem of the white point in the first display area 1 can be improved, and the problem of visible dark points where the blue sub-pixel 3031 is located can be avoided.

In an embodiment of the present disclosure, as shown in FIG. 1, in order to drive each sub-pixel in the first display area 1 and the second display area 2, the display panel provided by the embodiment of the present disclosure further includes a data driving circuit 5 and a scan driving circuit 6.

In conjunction with FIG. 1, along the first direction x, the scan driving circuit 6 is located on a side of the second display area 2 facing away from the first display area 1. In an embodiment of the present disclosure, the scanning line in the first display area 1 can be electrically connected to the scan driving circuit 6 through the scanning line located in the second display area 2. That is, scanning signals are provided to the first display area 1 and the second display area 2 by one scan driving circuit 6, which can reduce the number of the scan driving circuits 6 in the display panel.

Along the second direction y, the data driving circuit 5 is located on a side of the second display area 2 facing away from the first display area 1. In an embodiment of the present disclosure, the data line in the first display area 1 can be electrically connected to the data driving circuit 5 through the data line located in the second display area 2. That is, data driving signals are provided to the first display area 1 and the second display area 2 by one data driving circuit 5, which can reduce the number of the data driving circuits 5 in the display panel.

When providing sub-pixels in the first display area 1 and the second display area 2, as shown in FIG. 4, FIG. 5, FIG. 6, FIG. 7, FIG. 8, FIG. 9, and FIG. 10, in the first display area 1, the first-color sub-pixels 3011 and a first one of the first high-transmittance sub-pixels 3120 can be alternately arranged along the second direction y to form the first pixel column 3010, the second-color sub-pixels 3021 and a second one of the first high-transmittance sub-pixels 3120 can be alternately arranged along the second direction y to form the second pixel column 3020, and the third-color sub-pixels 3031 and a third one of the first high-transmittance sub-pixels 3021 can be alternately arranged along the second direction y to form the third pixel column 3030. The multiple data lines located in the first display area 1 are electrically connected to the multiple pixel columns mentioned above, respectively.

In the second display area 2, the first-color sub-pixels 3012 can be arranged along the second direction y to form a fourth pixel column 3040, the second-color sub-pixels 3022 can be arranged along the second direction y to a fifth pixel column 3050, and the third-color sub-pixels 3032 can be arranged along the second direction y to form a sixth pixel column 3060, and the data lines located in the second display area 2 are respectively electrically connected to the plurality of the pixel columns.

Figure 11:
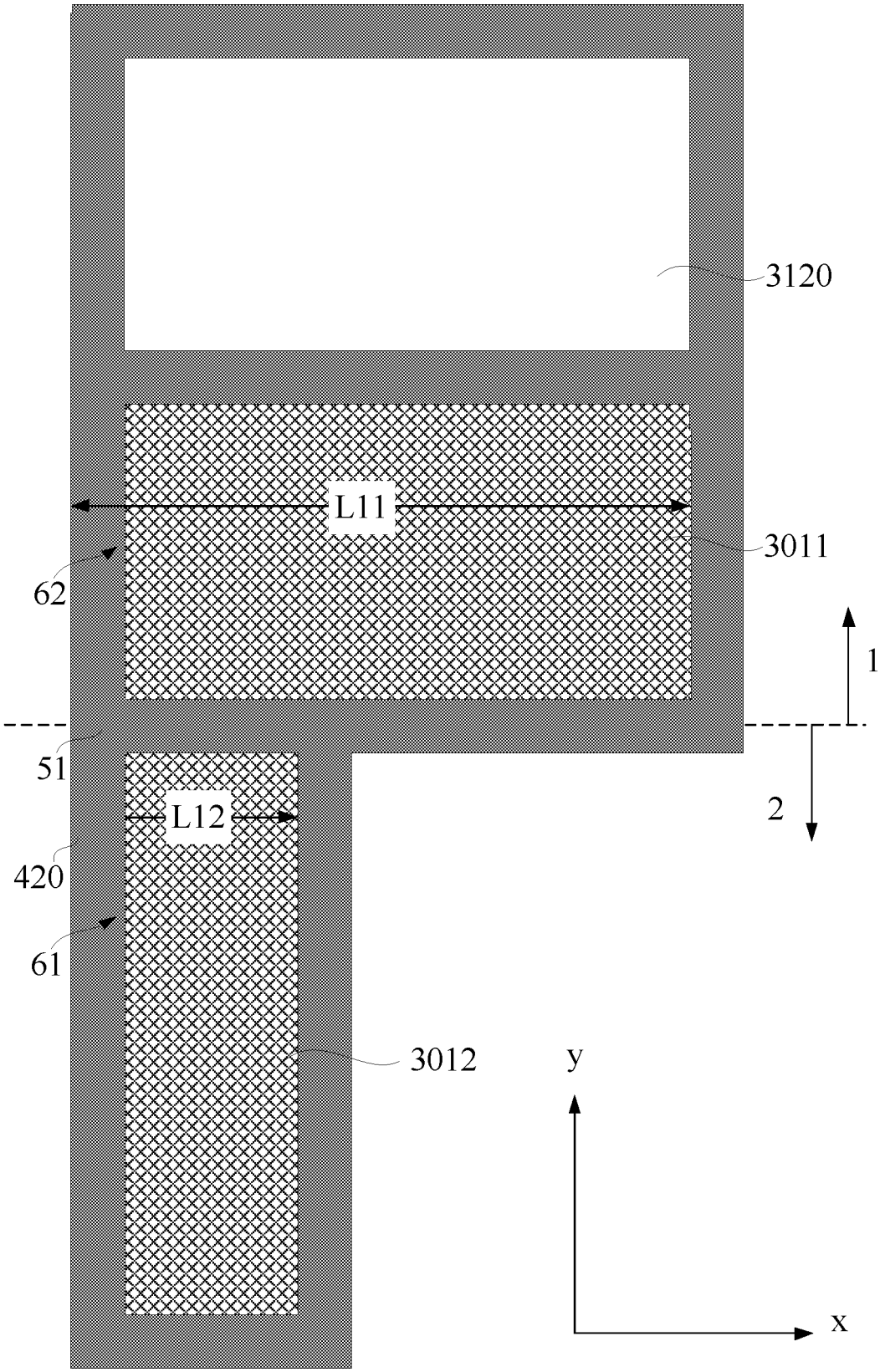
FIG. 11 is an enlarged schematic diagram of vicinity of a junction position of a first display area and a second display area.

When connecting the data line in the first display area 1 and the data line in the second display area 2, embodiments of the present disclosure provide multiple ways. FIG. 11 is an enlarged schematic diagram of a vicinity of a junction position of the first display area and the second display area. In an embodiment, as shown in FIG. 11, the data line includes a first data line 51 electrically connected to the first-color sub-pixels located in the first display area 1 and the second display area 2. The first data line 51 extends from the first display area 1 to the second display area 2 along the second direction y. With such arrangement, when the first display area 1 and the second display area 2 jointly display a single-color image of the first color, a data voltage on the first data line 51 are not switched multiple times between a high level and a low level, which can greatly reduce a change frequency of the voltage and a change amount of the voltage of the first data line 51, and there is no need to adjust an original driving algorithm of the display panel.

In an embodiment, as shown in FIG. 11, along the first direction x, the length L11 of the first-color sub-pixel 3011 in the first display area 1 is greater than the length L12 of the first-color sub-pixel 3012 in the second display area 2. Along the second direction y, some of the first-color sub-pixels 3012 in the second display area 2 have a first side 61, the first-color sub-pixel 3011 in the first display area 1 that is closest to the first side 61 has a second side 62, the first side 61 and the second side 62 extend along the second direction y, and an extension line of the first side 61 passes through the second side 62. As shown in FIG. 11, the first-color sub-pixel 3011 in the first display area 1 and the first-color sub-pixel 3012 in the second display area 2 can be located on the same side of the first data line 51, and the first data line 51 is placed on the first side 61 and the extension line of the first side 61.

It should be noted that in the liquid crystal display panel, the area where the sub-pixel is located, that is, the sides of the sub-pixels can be defined by the black matrix provided corresponding to the sub-pixel. As shown in FIG. 11, a black matrix 420 extending in the second direction y is provided at a position where the first side 61 and the second side 62 are located. In an embodiment, as shown in FIG. 3, the black matrix 420 is disposed on the color film substrate 42, and the first data line 51 is disposed on the array substrate 41. In an embodiment of the present disclosure, the first data line 51 being placed on the first side 61 and the extension line of the first side 61 indicates that an orthographic projection of the first data line 51 on the plane of the display panel overlaps an orthographic projection of the first side 61 of the sub-pixel on the plane of the display panel. In other words, as shown in FIG. 11, an orthographic projection of the black matrix 420 on the plane of the display panel covers an orthographic projection of the first data line 51 on the plane of the display panel.

It can be seen that the embodiment of the present disclosure, by making the extension line of the first side 61 pass through the second side 62 and then making the first data line 51 be electrically connected to the first-color sub-pixels located in the first display area 1 and the second display area 2, the first data line 51 can be set as a straight line extending in the second direction y to avoid winding the first data line 51 while reducing the power consumption of the display panel. With such configuration, in one aspect, it can be avoided that the length of the first data line 51 is too long, which can reduce delay and attenuation of the data signal when it is transmitted on the first data line 51. In another aspect, an area of the black matrix 420 used to cover the first data line 51 can also be reduced, which can increase the aperture ratio of the sub-pixels.

As shown in FIG. 11, the first data line 51 is further connected to the first high-transmittance sub-pixel 3120, and the first high-transmittance sub-pixel 3120 and the first-color sub-pixel 3011 in the first display area 1 are arranged along the second direction y.

Figure 12:
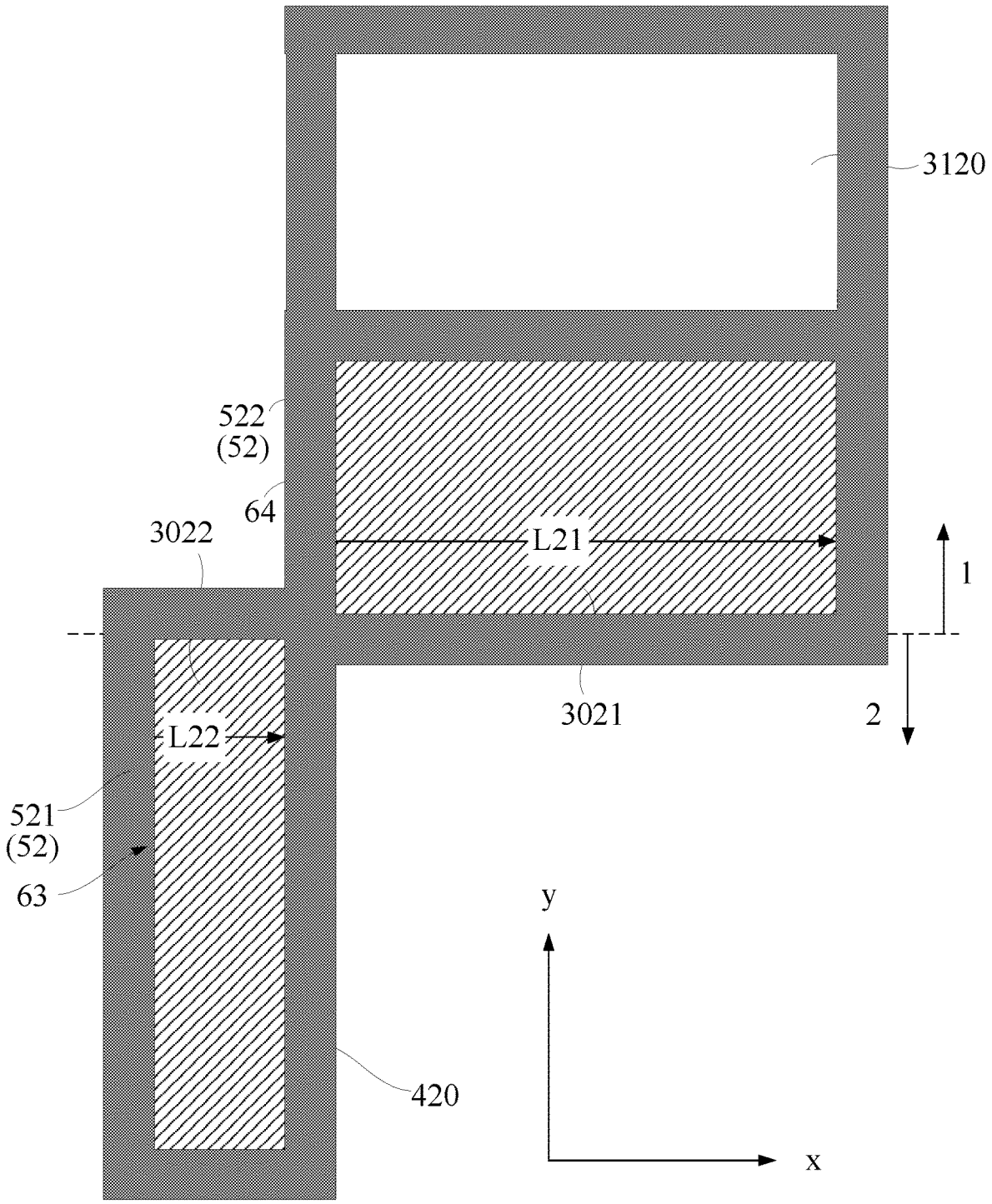
FIG. 12 is another enlarged schematic diagram of vicinity of a junction position of a first display area and a second display area.

FIG. 12 is another enlarged schematic diagram of the vicinity of the junction position of the first display area and the second display area. In an embodiment, as shown in FIG. 12, along the first direction x, a length L21 of the second-color sub-pixel 3021 in the first display area 1 is greater than a length L22 of the second-color sub-pixel 3022 in the second display area 2. A second data line 52 can be provided in the first display area 1 and the second display area 2 and electrically connected to the second-color sub-pixel. With such configuration, when the first display area 1 and the second display area 2 jointly display a single-color image of the second color, a data voltage on the second data line 52 are not switched multiple times between a high level and a low level, which can greatly reduce a change frequency of the voltage and a change amount of the voltage of the second data line 52.

In an embodiment, as shown in FIG. 12, along the second direction y, some of the second-color sub-pixels 3021 in the first display area 1 have a fourth side 64, a second-color sub-pixel 3022 in the second display area 2 that is closest to the fourth side 64 has a third side 63, and the third side 63 and the fourth side 64 are staggered from each other. An extension line of the third side 63 does not pass through the second-color sub-pixel 3021, and an extension line of the fourth side 64 does not pass through the second-color sub-pixel 3022. Definitions of the third side 63 and the fourth side 644 are similar to definitions of the first side and the second side described above, which will not be repeated herein.

In an embodiment, as shown in FIG. 12, along the first direction x, the second data line 52 be located on the same side of the second-color sub-pixel 3021 in the first display area 1 and the second-color sub-pixel 3022 in the second display area 2, a part of the second data line 52 extends in the second direction y and has a first portion located on the third side 63 and a second portion located on the fourth side 64. As shown in FIG. 12, the part of the second data line 52 extending along the second direction y includes a first sub-portion 521 and a second sub-portion 522, the first sub-portion 521 is located on the third side 63, and the second sub-portion 522 is located on the fourth side 64.

As shown in FIG. 12, the second data line 52 is further connected to the first high-transmittance sub-pixel 3120, and the first high-transmittance sub-pixels 3120 and the second-color sub-pixels 3021 located in the first display area 1 are arranged along the second direction y.

Figure 13:
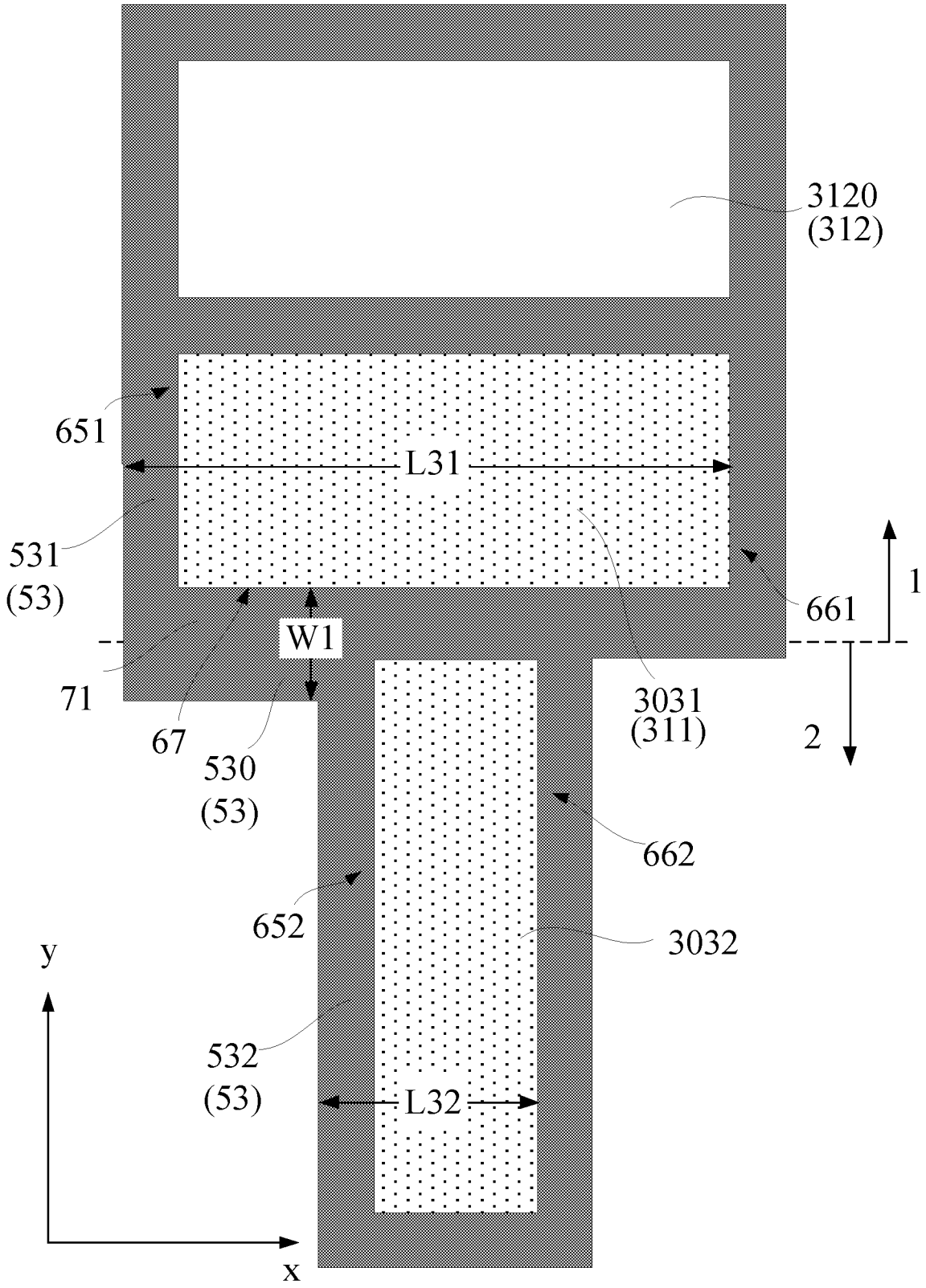
FIG. 13 is another enlarged schematic diagram of vicinity of a junction position of a first display area and a second display area.

FIG. 13 is another enlarged schematic diagram of the vicinity of the junction position of the first display area and the second display area. In an embodiment, as shown in FIG. 13, along the first direction x, a length L31 of the third-color sub-pixel 3031 in the first display area 1 is greater than a length L32 of the third-color sub-pixel in the second display area 2. A third data line 53 can be arranged in the first display area 1 and the second display area 2 and electrically connected to the third-color sub-pixel. With such configuration, when the first display area 1 and the second display area 2 jointly display a single-color image of the third color, a data voltage on the third data line 53 are not switched multiple times between a high level and a low level, which can greatly reduce a frequency change of the voltage and a change amount of the voltage of the third data line 53.

As shown in FIG. 13, the third-color sub-pixel includes a fifth side and a sixth side that are opposite to each other along the first direction x, the fifth side of the third-color sub-pixel 3031 in the first display area 1 is marked as 651, the sixth side of the third-color sub-pixel 3031 in the first display area 1 is marked as 661, the fifth side of the third-color sub-pixel 3032 in the second display area 2 is marked as 652, and the sixth side of the third-color sub-pixel 3032 in the second display area 2 is marked as 662. In the second display area 2, extension lines of the fifth side 652 and the sixth side 662 of some of the third-color sub-pixels 3032 pass through the third-color sub-pixel 3031 that is the closest in the first display area 1.

In an embodiment, the third data line 53 includes a first data sub-line 531, a second data sub-line 532, and a data connection line 530, the first data sub-line 531 is located in the first display area 1, the second data sub-line 532 is located in the second display area 2, and both the first data sub-line 531 and the second data sub-line 532 extend along the second direction y. The data connection line 530 connects the first data sub-line 531 with the second data sub-line 532, and an extension direction of the data connection line 530 is different from that of the first data sub-line 531 and that of the second data sub-line 532. The first data sub-line 531 is located on the fifth side 651 of the third-color sub-pixel 3031 in the first display area 1, and the second data sub-line 532 is located on the fifth side 652 of the third-color sub-pixel 3032 in the second display area 2. As shown in FIG. 13, the data connection line 530 can extend along an extension direction of a seventh side 67 of the third-color sub-pixel.

As shown in FIG. 13, the third data line 53 can be further connected with the first high-transmittance sub-pixel 3120, and the first high-transmittance sub-pixel 3120 and the third-color sub-pixel 3031 located in the first display area 1 are arranged along the second direction y.

In an embodiment, when connecting the data line in the first display area 1 and the data line in the second display area 2, sub-pixels of different colors respectively located in the first display area 1 and the second display area 2 are connected to the same data line.

Figure 14:
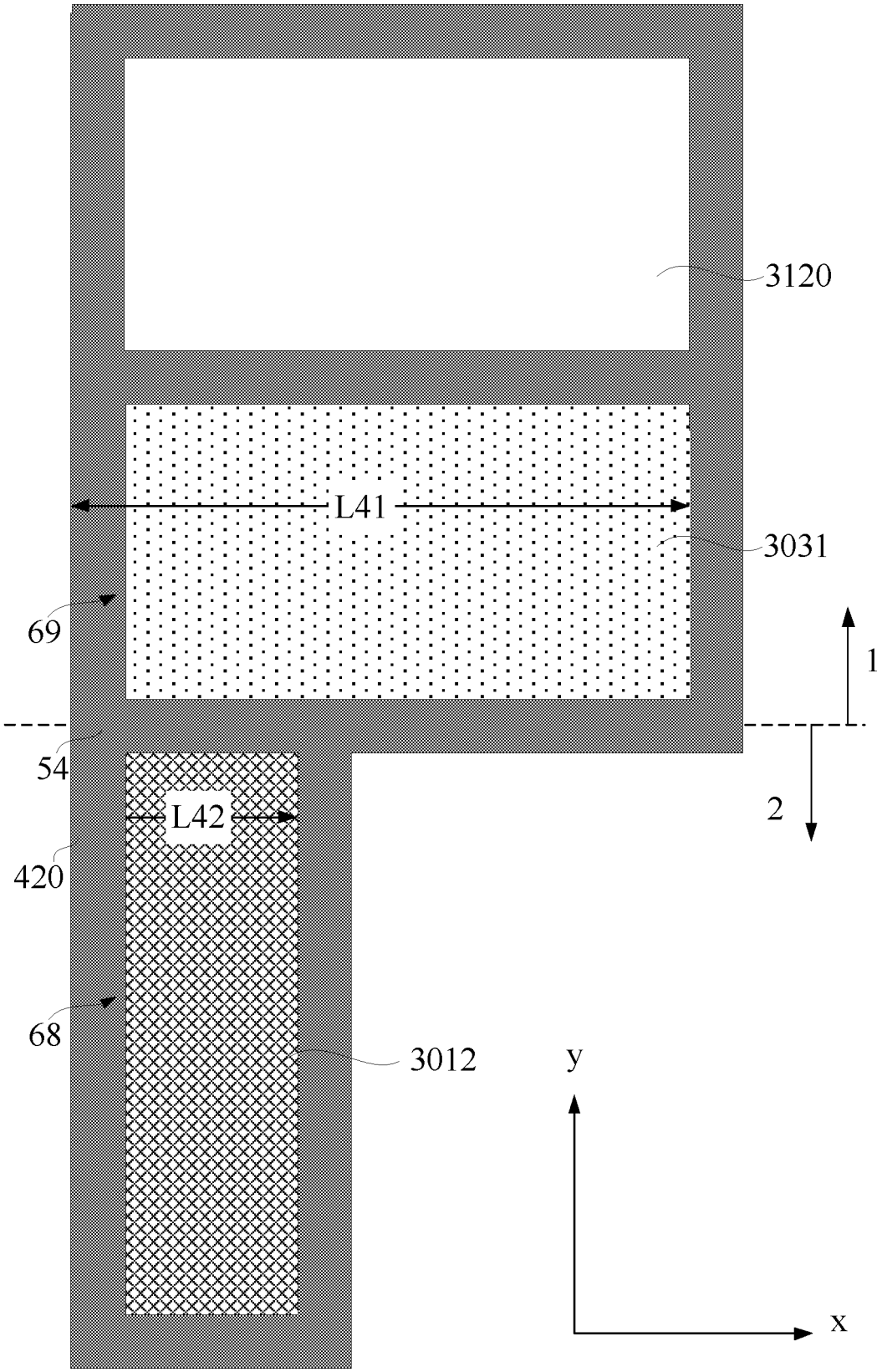
FIG. 14 is another enlarged schematic diagram of vicinity of a junction position of a first display area and a second display area.

FIG. 14 is another enlarged schematic diagram of the vicinity of the junction position of the first display area and the second display area. Exemplarily, as shown in FIG. 14, some of the third-color sub-pixels 3031 in the first display area 1 and some of the first-color sub-pixels 3012 in the second display area 2 are arranged along the second direction y. In an embodiment, a length L41 of the third-color sub-pixel 3031 in the first display area 1 is greater than a length L42 of the first-color sub-pixel 3012 in the second display area 2. Along the second direction y, some of the first-color sub-pixels 3012 in the second display area 2 each have an eighth side 68, the third-color sub-pixel 3031 in the first display area 1 that is closest to the eighth side 68 has a ninth side 69, the eighth side 68 and the ninth side 69 extend along the second direction y, and an extension line of the eighth side 68 passes through the ninth side 69.

As shown in FIG. 14, the display panel can further includes a fourth data line 54, the fourth data line 54 is electrically connected to the third-color sub-pixel 3031 in the first display area 1, and also electrically connected to the first-color sub-pixel 3012 in the second display area 2. It can be seen from FIG. 14 that, in this case, the fourth data line 54 extends from the first display area 1 to the second display area 2 along the second direction y. In an embodiment, the third-color sub-pixel 3031 in the first display area 1 and the first-color sub-pixel 3012 in the second display area 2 are located on the same side of the fourth data line 54.

It can be seen that with such configuration, the fourth data line 54 can be arranged as a straight line extending along the second direction y, to avoid winding of the fourth data line 54 while causing the fourth data line 54 to drive the third-color sub-pixel 3031 in the first display area 1 and the first-color sub-pixel 3012 in the second display area 2. In one aspect, it can avoid making a length of the fourth data line 54 too long, thereby reducing the delay and attenuation of the data signal when it is transmitted on the fourth data line 54. In another aspect, the area of the black matrix 420 for covering the fourth data line 54 can also be reduced, which increases the aperture ratio of the sub-pixels.

It should be noted that FIG. 14 is only an example to illustrate the embodiment of the present disclosure where the extension line of the eighth side 68 of the first-color sub-pixel 3012 in the second display area 2 passes through the ninth side 69 of the third-color sub-pixel 3031 in the first display area 1. According to different designs of the display panel, the embodiment of the present disclosure can also arrange extension lines of partial edges of other color sub-pixels in the second display area 2, such as the second-color sub-pixel 3022 and the third-color sub-pixel 3032, to pass through edges of the sub-pixels having different colors in the first display area 1, that is to say, one data line can also be provided to be respectively connected to the sub-pixel in the first display area 1 and the sub-pixel of a different color in the second display area, in order to reduce the length of the data line.

Figure 15:
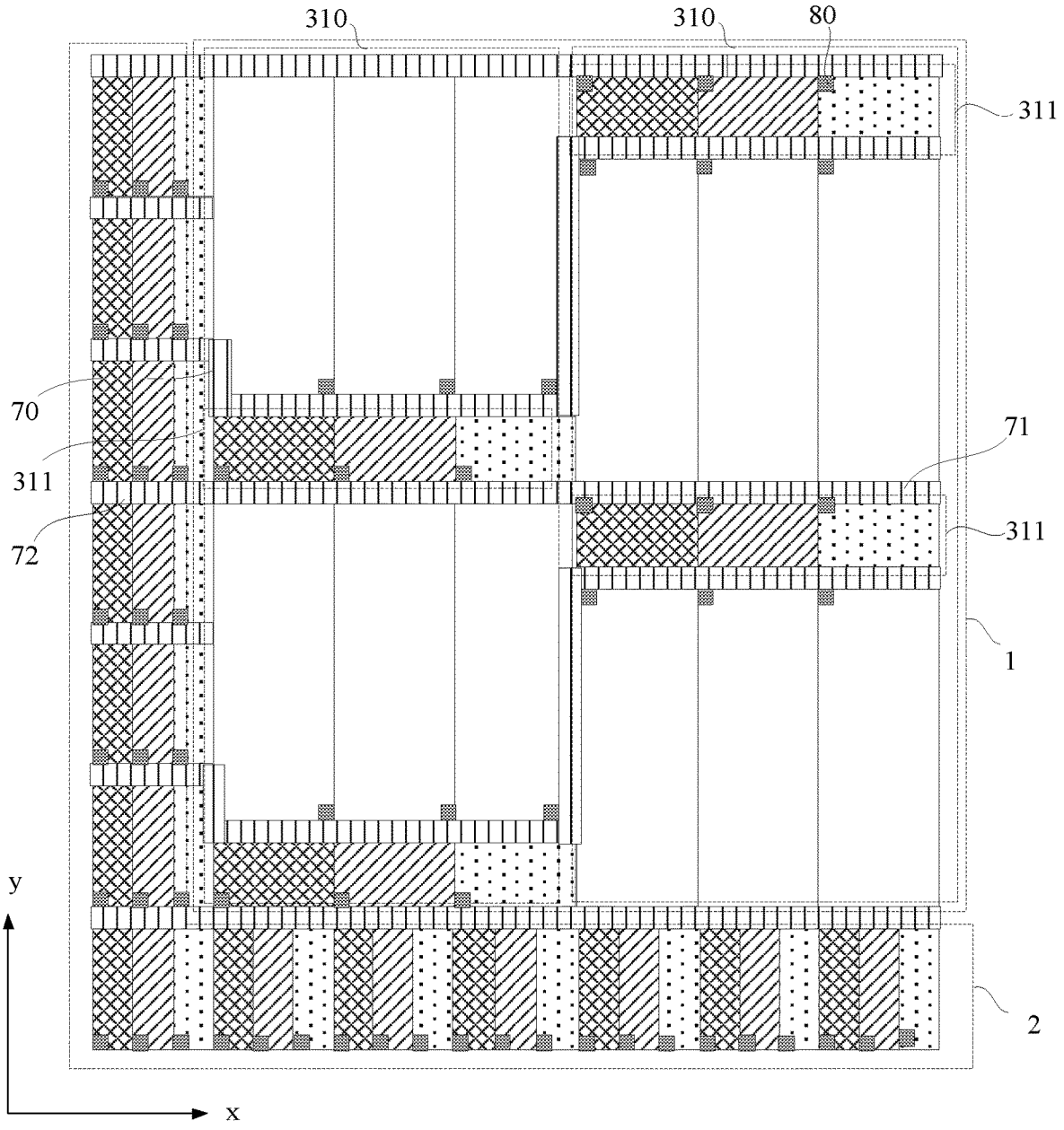
FIG. 15 is another enlarged schematic diagram of vicinity of a junction position of a first display area and a second display area.

FIG. 15 is another enlarged schematic diagram of the vicinity of the junction position of the first display area and the second display area. In an embodiment, as shown in FIG. 15, the scanning lines 7 above includes a plurality of the first scanning lines 71 located in the first display area 1, the first scanning line 71 extends along the first direction x, and the plurality of first scanning lines 71 are arranged along the second direction y. The first scanning line 71 is electrically connected to two adjacent first sub-pixel rows 311. Along the second direction y, the first scanning line 71 is located between two adjacent first sub-pixel rows 311 that are electrically connected to the first scanning line 71, and the two adjacent first sub-pixel rows 311 are respectively located in two adjacent first pixel unit columns 310. In an embodiment, as shown in FIG. 14, the first scanning line 71 is electrically connected to the corresponding sub-pixel through the TFT 80. With this arrangement, two first sub-pixel rows that belong to two adjacent first pixel unit columns and are closest to each other in the first display area are staggered from each other in the first direction to improve the display effect of the first display area 1, the first scanning line 71 can be set as a straight line extending along the first direction x, to avoid winding the first scanning line 71, which shortens the length of the first scanning line 71 and reduces the area of the black matrix (not shown in FIG. 15) for covering the first scanning line 71.

As shown in FIG. 15, second scanning lines 72 can be provided in the second display area 2 and arranged along the second direction y, and the second scanning line 72 extend along the first direction x. One second scanning line 72 is connected to one sub-pixel row in the second display area 2.

As shown in FIG. 15, the first scanning line 71 is connected to the scan driving circuit (not shown) through the second scanning line 72 that is closest to the first scanning line 71, so that the length of a scan connection line 70 between the first scanning line 71 and the second scanning line 72 can be shortened while driving the two display areas by one scan driving circuit for display. As shown in FIG. 14, the scan connection line 70 extends along the second direction y.

As shown in FIG. 13, for the first sub-pixel row 311 disposed adjacent to the second display area 2 in the display panel, the first scanning line 71 connected to the first sub-pixel row 311 extends in a direction same as an direction along which the aforementioned data connection line 530 extends, and an orthographic projection of the first scanning line 71 on the plane of the display panel and the orthographic projection of the data connection line 530 on the plane of the display panel do not overlap, in order to reduce interference degree of different signals transmitted on the first scanning line 71 and the data connection line 530.

As shown in FIG. 13, in the display panel, the orthographic projection of the black matrix 420 on the plane of the display panel covers the first scanning line 71 and the data connection line 530. In an embodiment, a width W1 of the black matrix 420 at the positions corresponding to the first scanning line 71 and the data connection line 530 is greater than a width of the black matrix 420 at a position where the data connection line 530 is not provided.

Figure 16:
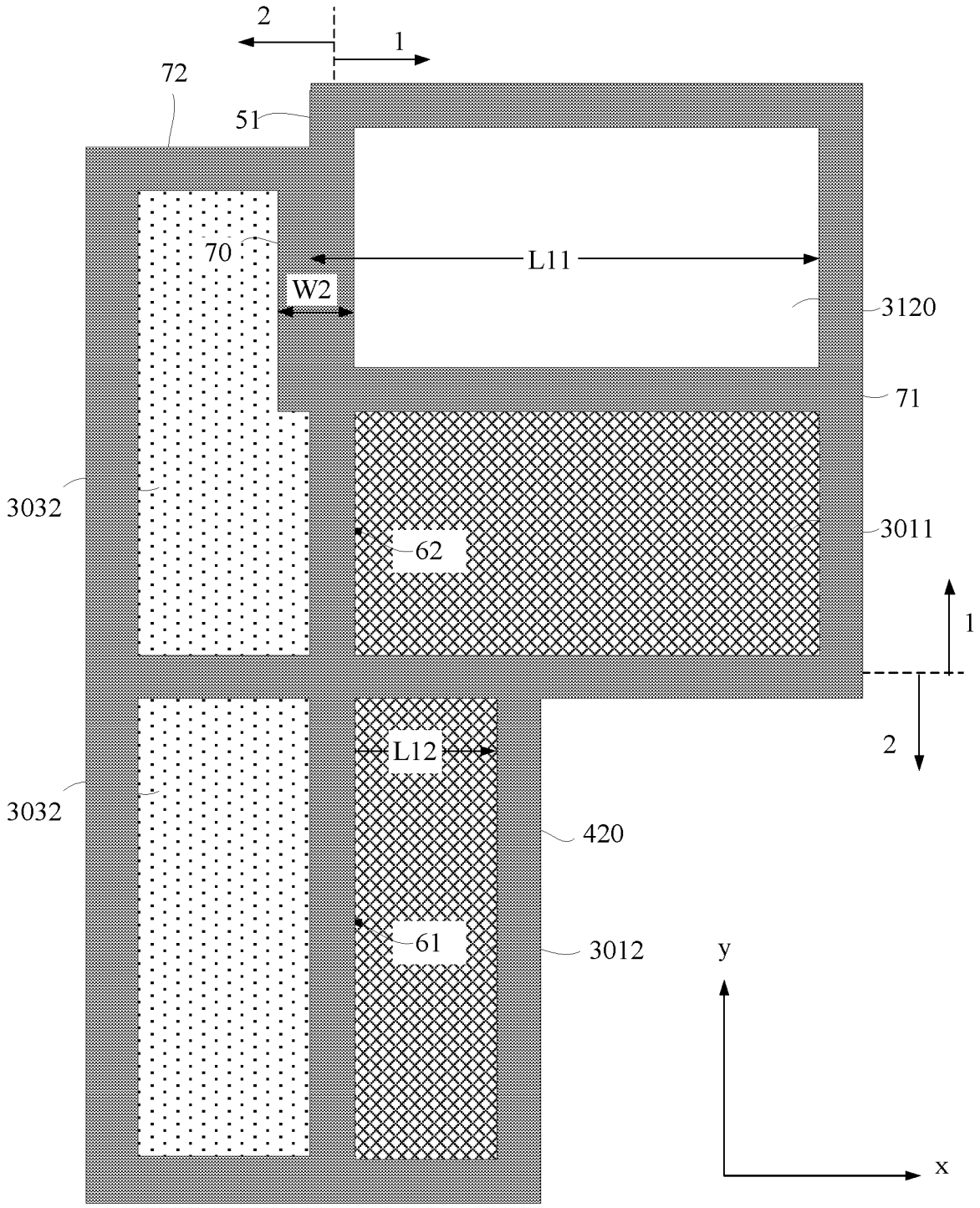
FIG. 16 is another enlarged schematic diagram of vicinity of a junction position of a first display area and a second display area.

FIG. 16 is another enlarged schematic diagram of the vicinity of the junction position of the first display area and the second display area. In an embodiment, as shown in FIG. 16, for the first pixel unit column 310 arranged adjacent to the second display area 2 in the display panel, the extension direction of the first data line 51 connected to the first column of sub-pixels in the first pixel unit column 310 is the same as the extension direction of the scan connection line 70 described above, and the orthographic projection of the first data line 51 on the plane of the display panel and the orthographic projection of the scan connection line 70 on the plane of the display panel do not overlap, in order to reduce the interference degree of different signals transmitted on the first data line 51 and the scan connection line 70.

As shown in FIG. 16, in the display panel, the orthographic projection of the black matrix 420 on the plane of the display panel covers the first data line 51 and the scan connection line 70. In an embodiment, a width W2 of the black matrix 420 at the positions corresponding to the first data line 51 and the scan connection line 70 is greater than the width of the black matrix 420 at the position where the scan connection line 70 is not provided.

Figure 17:
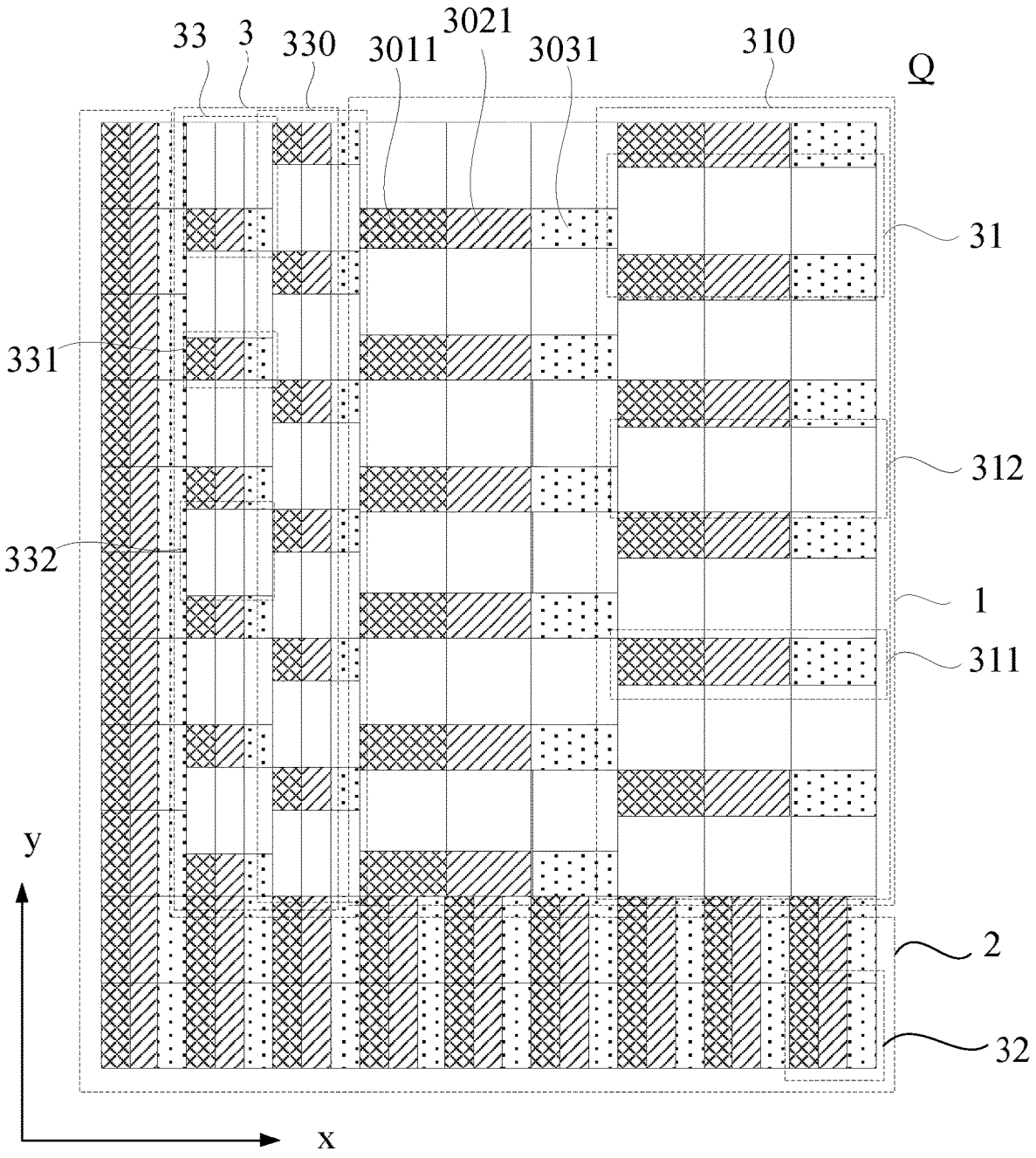
FIG. 17 is another enlarged schematic diagram of an area Q in FIG. 1.

In an embodiment, the display panel provided by the embodiment of the present disclosure further has a transition area, and along the first direction x, the transition area is located between the first display area 1 and the second display area 2. In an embodiment, the display panel provided by the embodiment of the present disclosure further has a transition area, and along the second direction y, the transition area is located between the first display area 1 and the second display area 2. In an embodiment, the display panel provided by the embodiment of the present disclosure further has a transition area, and along the first direction x and the second direction y, the transition area is located between the first display area 1 and the second display area 2. A plurality of third pixel units are provided in the transition area. The density of the first pixel unit 31 is smaller than a density of the third pixel unit, and the density of the third pixel unit is smaller than the density of the second pixel unit 32. FIG. 17 is another enlarged schematic diagram of the area Q in FIG. 1. In an embodiment, as shown in FIG. 17, in the first direction x, a transition area 3 is provided between the first display area 1 and the second display area 2. As shown in FIG. 17, the third pixel unit 33 includes a third sub-pixel row 331 and a fourth sub-pixel row 332, and the third sub-pixel row 331 includes a plurality of the sub-pixels of different colors arranged along the first direction x. Exemplarily, types of colors of the sub-pixels included in the third sub-pixel row 331 can be the same as those in the first display area 1 and the second display area 2. The fourth sub-pixel row 332 includes second high-transmittance sub-pixels, and the third sub-pixel row 331 and the fourth sub-pixel row 332 are arranged along the second direction y.

In the transition area 3, the third pixel units 33 are arranged along the second direction y to form a third pixel unit column 330, and the third pixel unit columns 330 are arranged along the first direction x; in one third pixel unit column 330, the third sub-pixel rows 331 and the fourth sub-pixel rows 332 are alternately arranged; and two third sub-pixel rows 331 that belong to two adjacent third pixel unit columns 330 and are closest are staggered from each other in the first direction x.

Along the first direction x, the number of the third pixel units in a unit length in the transition area is c1. Along the second direction y, the number of the third pixel units in a unit length in the transition area is c2. In an embodiment of the present disclosure, $1:4<a1:b1<c1:b1\leq 1$, so that the density of the third pixel unit 33 in the transition area 3 is between the density of the first pixel unit in the first display area 1 and the density of the second pixel unit in the second display area 2, and when both the first display area 1 and the second display area 2 are used for display, the setting of the transition area 3 can prevent an obvious boundary from appearing between the first display area 1 and the second display area 2, thereby making the display image form a smoother transition between the two. In an embodiment of the present disclosure, $1:4<a2:b2\leq c2:b2\leq 1$. In an embodiment of the present disclosure, $1:4<a1:b1\leq c1:b1\leq 1$, and, $1:4<a2:b2\leq c2:b2\leq 1$, Exemplarily, along a direction from the first display area 1 to the second display area 2, a ratio of c1:b1 gradually increases, so as to improve the transition of the display image between the first display area 1 and the second display area 2 to be smoother. Exemplarily, along the direction from the first display area 1 to the second display area 2, a ration of c2:b2 gradually increases, so as to improve the transition of the display image between the first display area 1 and the second display area 2 to be smoother. Exemplarily, along the direction from the first display area 1 to the second display area 2, the ratio of c1:b1 gradually increases, and the ration of c2:b2 gradually increases, so as to improve the transition of the display image between the first display area 1 and the second display area 2 to be smoother.

It should be noted that shapes and areas of the first display area 1 and the second display area 2 shown in FIG. 1 are only illustrative, and in an embodiment of the present disclosure, the shape of the first display area 1 can be designed as a circle, an ellipse, or other shapes, which is not limited in this embodiment. In an embodiment of the present disclosure, the shape of the second display area 2 can be designed as a circle, an ellipse, or other shapes, which is not limited in this embodiment. In an embodiment of the present disclosure, the shape of the first display area 1 and the shape of the second display area 2 can be designed as a circle, an ellipse, or other shapes, which is not limited in this embodiment.

In addition, FIG. 1 only shows one position of the first display area 1 on the display panel, and in some other embodiments of the present disclosure, the first display area 1 can also be arranged in other positions of the display panel. In addition, the embodiment of the present disclosure does not limit the number of the first display area 1. For example, the first display area 1 can be designed into two or more according to the number and area of the light-collecting modules required to be provided.

Figure 18:
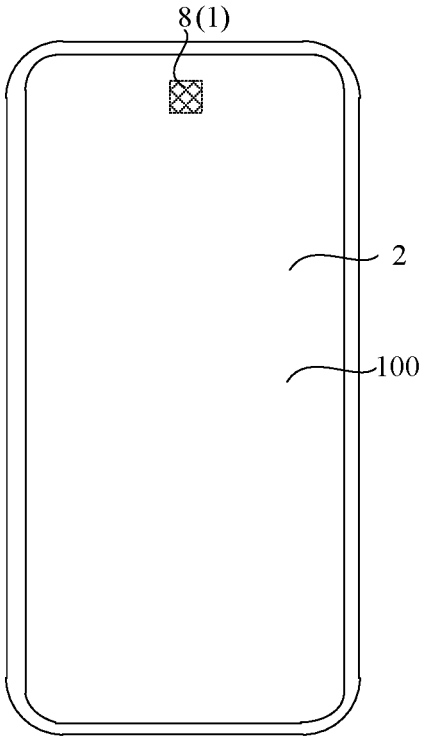
FIG. 18 is a top view of a display device according to an embodiment of the present disclosure.

An embodiment of the present disclosure also provides a display device. FIG. 18 is a top view of a display device provided by an embodiment of the present disclosure. As shown in FIG. 18, the display device includes a light-collecting module 8 and the above-mentioned display panel 100. An orthographic projection of the light-collecting module 8 on the plane of the display panel is located in the first display area 1. The structure of the display panel 100 has been described in detail in the above-mentioned embodiments, and it will not be repeated herein. Without doubt, the display device shown in FIG. 18 is only a schematic illustration, and the display device can be any electronic device with a display function, such as a mobile phone, a tablet computer, a notebook computer, an electronic paper book, or a television.

An embodiment of the present disclosure also provides a driving method applied to the above-mentioned display panel, and the display panel includes a display mode and a light-collecting mode. As shown in conjunction with FIG. 1 and FIG. 2, the driving method includes step 1 and step 2.

At step 1, in the light-collecting mode, at least the second sub-pixel row 312 in the first pixel unit 31 is controlled to be lit up. When the first high-transmission sub-pixel 3120 in the second sub-pixel row 312 is lit, the deflection angle of the liquid crystal corresponding to the first high-transmission sub-pixel 3120 allows light to pass. For example, when the light-collecting module is the camera module, the light-collecting mode can be a camera mode in which the camera module is turned on. In the camera mode, ambient light can enter the camera module provided corresponding to the first display area 1 through the liquid crystal 40 in the area where the first high-transmittance sub-pixel 3120 is located. When the light-collecting module is the fingerprint recognition module, after light emitted by the fingerprint recognition light source is reflected by a finger on the light emission side of the display panel, reflected light can enter the fingerprint recognition module provided corresponding to the first display area 1 through the liquid crystal 40 in the area where the first high-transmittance sub-pixel 3120 is located.

At step 2, in the display mode, the first pixel unit 31 is controlled to be lit up so that the first display area 1 can be used for display. When the second display area 2 also displays, the first display area 1 and the second display area 2 can jointly display a complete image. In an embodiment, the first display area 1 and the second display area 2 can display independently. For example, the first display area 1 can be used to display information such as date, time, and call reminder.

In an embodiment, in the display mode, the step 2 in which the first pixel unit 31 is controlled to be lit up includes: when a gray scale of the first high-transmittance sub-pixel 3120 is the same as a gray scale of the sub-pixel in the first sub-pixel row 311, controlling a data voltage of the first high-transmittance sub-pixel 3120 to be smaller than a data voltage of the sub-pixel in the first sub-pixel row 311.

Due to the relatively high light transmittance of the first high-transmittance sub-pixel 3120, the data voltage of the first high-transmittance sub-pixel 3120 is controlled to be smaller than the data voltage of the sub-pixel in the first sub-pixel row 311, which can prevent brightness of the first high-transmittance sub-pixel 3120 from being excessively high. For example, when an image to be displayed is a white image, the driving method of the embodiment of the present disclosure can make brightness at different positions in the first display area 1 tend to be consistent, and it can also make no obvious bright or dark areas in the white image displayed jointly by the first display area 1 and the second display area 2.

The foregoing descriptions are only some embodiments of the present disclosure and are not intended to limit the present disclosure. Those skilled in the art can make any modification, equivalent replacement, improvement, etc.

What is claimed is:

1. A display panel, the display panel having a first display area and a second display area, and the second display area at least partially surrounding the first display area; and the display panel comprising:

a plurality of first pixel units arranged in the first display area; and a plurality of second pixel units arranged in the second display area, wherein a density of the plurality of first pixel units is smaller than a density of the plurality of second pixel units;

wherein each of the plurality of first pixel units comprises a first sub-pixel row and a second sub-pixel row, the first sub-pixel row comprises a plurality of sub-pixels of different colors arranged along a first direction, and the second sub-pixel row comprises first high-transmittance sub-pixels; the first sub-pixel row and the second sub-pixel row are arranged along a second direction, and the first direction intersects the second direction;

in the first display area, at least two of the plurality of first pixel units are arranged along the second direction to form one of first pixel unit columns, and the first pixel unit columns are arranged along the first direction; and in one of the first pixel unit columns, the first sub-pixel rows and the second sub-pixel rows of at least two of the plurality of first pixel units are alternately arranged;

two closest first sub-pixel rows of the first sub-pixel rows of the plurality of first pixel units are respectively located in two adjacent ones of the first pixel unit columns and are staggered from each other in the first direction; and along the first direction, a number of the first pixel units in a unit length of at least two of the plurality of first pixel units in a row is a1, and a number of the second pixel units in a unit length in at least two of the plurality of second pixel units in a row is b1, and a1:b1>1:4; or along the second direction, a number of the first pixel units in a unit length of a column of first pixel units of the plurality of first pixel units is a2, a number of the second pixel units in a unit length of a column of second pixel units of the plurality of second pixel units is b2, and a2:b2>1:4.

2. The display panel according to claim 1, wherein a1:b1=1:3.

3. The display panel according to claim 1, wherein a1:b1=2:3.

4. The display panel according to claim 1, wherein the first sub-pixel row and each of the plurality of second pixel units both comprise a first-color sub-pixel, and along the first direction, a length of the first-color sub-pixel of the first sub-pixel row in the first display area is greater than a length of the first-color sub-pixel of the second pixel unit in the second display area;

along the second direction, the first-color sub-pixel of one of the plurality of second pixel units in the second display area have a first side, and the first-color sub-pixel of the first sub-pixel row of one of the plurality of first pixel units in the first display area is closest to the first side and has a second side, wherein an extension line of the first side passes through the second side;

the display panel further comprises first data lines located in the first display area and the second display area and extending along the second direction, wherein the first data lines are electrically connected to the first-color sub-pixel of the first sub-pixel row and the first-color sub-pixel of each of the plurality of second pixel units;

the first-color sub-pixel of the first sub-pixel row in the first display area and the first-color sub-pixel of one of the plurality of second pixel units in the second display area are located at a same side of one of the first data lines; and the first data line is provided on the first side and the extension line of the first side.

5. The display panel according to claim 4, wherein the first sub-pixel row and each of the plurality of second pixel units both further comprise a second-color sub-pixel; along the first direction, a length of the second-color sub-pixel of the first sub-pixel row in the first display area is greater than a length of the second-color sub-pixel of each of the plurality of second pixel units in the second display area;

along the second direction, the second-color sub-pixel of the first sub-pixel row in the first display area have a fourth side, and the second-color sub-pixel of one of the plurality of second pixel units in the second display area is closest to the fourth side and has a third side, wherein the third side and the fourth side are staggered;

the display panel further comprises second data lines located in the first display area and the second display area and extending along the second direction, wherein the second data lines are electrically connected to the second-color sub-pixel of the first sub-pixel row and the second-color sub-pixel of each of the plurality of second pixel units;

along the first direction, the second data line is located at a same side of the second-color sub-pixel of the first sub-pixel row of one of the plurality of first pixel units in the first display area and the second-color sub-pixel of one of the plurality of second pixel units in the second display area; and the second data line comprises a first part extending along the second direction and located on the third side, and a second part extending along the second direction and located on the fourth side.

6. The display panel according to claim 4, wherein the first sub-pixel row and each of the plurality of second pixel units both further comprise a third-color sub-pixel, and along the first direction, a length of the third-color sub-pixel of the first sub-pixel row in the first display area is greater than a length of the third-color sub-pixel of each of the plurality of second pixel units in the second display area;

the third-color sub-pixel has a fifth side and a sixth side that are opposite to each other along the first direction; extension lines of the fifth side and the sixth side of the third-color sub-pixel of one of the plurality of second pixel units in the second display area both pass through the third-color sub-pixel of the first sub-pixel row of one the plurality of first pixel units closest to the third-color sub-pixel of the second pixel unit;

the display panel further comprises third data lines arranged in the first display area and the second display area, the third data lines are electrically connected to the third-color sub-pixel of the first sub-pixel row and the third-color sub-pixel of each of the plurality of second pixel units, and the third data line comprises a first data sub-line, a second data sub-line and a data connection line; the first data sub-line is located in the first display area, the second data sub-line is located in the second display area, and both the first data sub-line and the second data sub-line extend along the second direction; the data connection line connects the first data sub-line with the second data sub-line and extends in a direction different from the second direction; and the first data sub-line is located on the fifth side of the third-color sub-pixel of the first sub-pixel row in the first display area, and the second data sub-line is located on the fifth side of the third-color sub-pixel of one of the plurality of second pixel units in the second display area.

7. The display panel according to claim 6, further comprising:

a first scanning line connected to the first sub-pixel row, wherein the first scanning line extends in a direction along which the data connection line extends, and an orthographic projection of the first scanning line on a plane of the display panel and an orthographic projection of the data connection line on the plane of the display panel do not overlap.

8. The display panel according to claim 7, further comprising:

a black matrix, wherein an orthographic projection of the black matrix on the plane of the display panel covers the first scanning line and the data connection line.

9. The display panel according to claim 1, wherein a2:b2=2:3.

10. The display panel according to claim 1, wherein a2:b2=1:3.

11. The display panel according to claim 1, further comprising:

a plurality of first scanning lines arranged in the first display area and arranged along the second direction, wherein each of the plurality of first scanning lines extends along the first direction; and along the second direction, one of the plurality of first scanning lines is located between two adjacent first sub-pixel rows of the first sub-pixel rows of the plurality of first pixel units, and the two adjacent first sub-pixel rows are respectively located in two adjacent first pixel unit columns of the first pixel unit columns, and the first scanning line is electrically connected to the two adjacent first sub-pixel rows.

12. The display panel according to claim 11, further comprising:

a plurality of second scanning lines arranged in the second display area and arranged along the second direction, wherein each of the plurality of second scanning lines extends along the first direction, and one of the plurality of first scanning lines is electrically connected to one of the plurality of second scanning lines closest to the first scanning line.

13. The display panel according to claim 1, wherein the display panel further has a transition area, and along at least one of the first direction or the second direction, the transition area is located between the first display area and the second display area; and the display panel further comprises a plurality of third pixel units arranged in the transition area, wherein the density of the plurality of first pixel units is smaller than a density of the plurality of third pixel units, and the density of the plurality of third pixel units is smaller than the density of the plurality of second pixel units.

14. The display panel according to claim 13, wherein each of the plurality of third pixel units comprises a third sub-pixel row and a fourth sub-pixel row that are arranged along the second direction, the third sub-pixel row comprises a plurality of sub-pixels of different colors arranged along the first direction, and the fourth sub-pixel row comprises second high-transmittance sub-pixels;

in the transition area, at least two third pixel units of the plurality of the third pixel units are arranged along the second direction to form one of third pixel unit columns, the third pixel unit columns are arranged along the first direction, and in one of the third pixel unit columns, the third sub-pixel rows of at least two of the plurality of third pixel units and the fourth sub-pixel rows of at least two of the plurality of third pixel units are alternately arranged;

two closest third sub-pixel rows of the third sub-pixel rows of the plurality of third pixel units are respectively located in two adjacent ones of the third pixel unit columns and are staggered from each other in the first direction;

along the first direction, a number of the first pixel units in a unit length of at least two of the plurality of first pixel units in a row is a1, a number of the second pixel units in a unit length in the second display area is b1, and a number of the third pixel units in a unit length in the transition area is c1;

along the second direction, a number of the first pixel units in a unit length of at least two of the plurality of second pixel units in a column is a2, a number of the second pixel units in a unit length in the second display area is b2, and a number of the third pixel units in a unit length in the transition area is c2; and a1, a2, b1, b2, c1, and c2 satisfy at least one of $1:4<a1:b1\leq c1:b1\leq 1$, or $1:4<a2:b2\leq c2:b2\leq 1$.

15. The display panel according to claim 1, wherein the plurality of sub-pixels of different colors comprises a red sub-pixel, a green sub-pixel, and a blue sub-pixel, and the first high-transmittance sub-pixels comprise a white sub-pixel; and in each of the plurality of first pixel units, at least one of the red sub-pixel or the green sub-pixel has an area smaller than an area of the blue sub-pixel.

16. The display panel according to claim 15, wherein in each of the plurality of first pixel units, a length of the blue sub-pixel in the first direction and a length of the blue sub-pixel in the second direction are both smaller than or equal to 65 μm.

17. A display device, comprising:

a light-collecting module; and a display panel, wherein an orthographic projection of the light-collecting module on a plane of the display panel is located in a first display area, wherein the display panel has the first display area and a second display area, and the second display area at least partially surrounding the first display area; and wherein the display panel comprises:

a plurality of first pixel units arranged in the first display area; and a plurality of second pixel units arranged in the second display area, wherein a density of the plurality of first pixel units is smaller than a density of the plurality of second pixel units;

wherein each of the plurality of first pixel units comprises a first sub-pixel row and a second sub-pixel row, the first sub-pixel row comprises a plurality of sub-pixels of different colors arranged along a first direction, and the second sub-pixel row comprises first high-transmittance sub-pixels; the first sub-pixel row and the second sub-pixel row are arranged along a second direction, and the first direction intersects the second direction;

in the first display area, at least two of the plurality of first pixel units are arranged along the second direction to form one of first pixel unit columns, and the first pixel unit columns are arranged along the first direction; and in one of the first pixel unit columns, the first sub-pixel rows and the second sub-pixel rows of at least two of the plurality of first pixel unit are alternately arranged;

two closest first sub-pixel rows of the first sub-pixel rows of the plurality of first pixel units are respectively located in two adjacent ones of the first pixel unit columns and are staggered from each other in the first direction; and along the first direction, a number of the first pixel units in a unit length of at least two of the plurality of first pixel units in a row is a1, and a number of the second pixel units in a unit length in at least two of the plurality of second pixel units in a row is b1, and $a1:b1>1:4$; or wherein along the second direction, a number of the first pixel units in a unit length of a column of first pixel units of the plurality of first pixel units is a2, a number of the second pixel units in a unit length of a column of second pixel units of the plurality of second pixel units is b2, and $a2:b2>1:4$.

18. A driving method applied to a display panel, wherein the display panel has a first display area and a second display area, and the second display area at least partially surrounding the first display area;

wherein the display panel comprises:

a plurality of first pixel units arranged in the first display area; and a plurality of second pixel units arranged in the second display area, wherein a density of the plurality of first pixel units is smaller than a density of the plurality of second pixel units;

wherein each of the plurality of first pixel units comprises a first sub-pixel row and a second sub-pixel row, the first sub-pixel row comprises a plurality of sub-pixels of different colors arranged along a first direction, and the second sub-pixel row comprises first high-transmittance sub-pixels; the first sub-pixel row and the second sub-pixel row are arranged along a second direction, and the first direction intersects the second direction;

in the first display area, at least two of the plurality of first pixel units are arranged along the second direction to form one of first pixel unit columns, and the first pixel unit columns are arranged along the first direction; and in one of the first pixel unit columns, the first sub-pixel rows and the second sub-pixel rows of at least two of the plurality of first pixel unit are alternately arranged;

two closest first sub-pixel rows of the first sub-pixel rows of the plurality of first pixel units are respectively located in two adjacent ones of the first pixel unit columns and are staggered from each other in the first direction;

along the first direction, a number of the first pixel units in a unit length of at least two of the plurality of first pixel units in a row is a1, and a number of the second pixel units in a unit length in at least two of the plurality of second pixel units in a row is b1, and a1:b1>1:4; or along the second direction, a number of the first pixel units in a unit length of a column of first pixel units of the plurality of first pixel units is a2, a number of the second pixel units in a unit length of a column of second pixel units of the plurality of second pixel units is b2, and a2:b2>1:4;

wherein the display panel has a display mode and a light-collecting mode; and wherein the driving method comprises:

in the light-collecting mode, controlling at least the second sub-pixel row in each of the plurality of first pixel units to be lit up; and in the display mode, controlling the plurality of first pixel units to be lit up.

19. The driving method according to claim 18, wherein in the display mode, said controlling the plurality of first pixel units to be lit up comprises:

when a gray scale of one high-transmittance sub-pixel of the first high-transmittance sub-pixels is the same as a gray scale of one sub-pixel of the plurality of sub-pixels of different colors in the first sub-pixel row, controlling a data voltage of the first high-transmittance sub-pixel to be lower than a data voltage of the sub-pixel.

* * * * *